US012421062B2

(12) United States Patent
Tsuda

(10) Patent No.: US 12,421,062 B2
(45) Date of Patent: Sep. 23, 2025

(54) SHEET FEEDING DEVICE

(71) Applicant: CANON KABUSHIKI KAISHA, Tokyo (JP)

(72) Inventor: Satoshi Tsuda, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 398 days.

(21) Appl. No.: 18/058,638

(22) Filed: Nov. 23, 2022

(65) Prior Publication Data

US 2023/0166928 A1 Jun. 1, 2023

(30) Foreign Application Priority Data

Dec. 1, 2021 (JP) ..... 2021-195324
Dec. 1, 2021 (JP) ..... 2021-195325

(51) Int. Cl.
*B65H 3/06* (2006.01)

(52) U.S. Cl.
CPC ..... *B65H 3/0684* (2013.01); *B65H 3/0638* (2013.01); *B65H 2404/13421* (2013.01); *B65H 2404/1421* (2013.01); *B65H 2601/324* (2013.01); *B65H 2801/06* (2013.01)

(58) Field of Classification Search
CPC ..... B65H 3/54; B65H 3/0684; B65H 2404/13421; B65H 2404/1421; B65H 2601/324
See application file for complete search history.

(56) References Cited

U.S. PATENT DOCUMENTS 8,328,182 B2 * 12/2012 Iino ..... B65H 3/0684 271/117
9,617,091 B2 * 4/2017 Matsuo ..... B65H 3/0684
9,771,226 B2 * 9/2017 Zensai ..... B65H 1/18
9,828,197 B2 * 11/2017 Hashimoto ..... G03G 15/6511
10,584,006 B2 * 3/2020 Suzuki ..... B65H 5/062
11,981,526 B2 * 5/2024 Yoshida ..... B65H 3/06
12,024,384 B2 * 7/2024 Yoshida ..... B65H 3/06
2006/0267269 A1 * 11/2006 Yano ..... B65H 3/0684 271/127

(Continued)

FOREIGN PATENT DOCUMENTS

JP 2018080051 A 5/2018
JP 6849416 B2 3/2021

*Primary Examiner* — Patrick Cicchino
(74) *Attorney, Agent, or Firm* — CANON U.S.A., INC. IP DIVISION

(57) ABSTRACT

A sheet feeding device includes a roller unit having first and second engagement units, a first engaged unit, and a pressing arm having a second engaged unit. By being rotated about the first engagement unit from a first position where the first engagement unit and the first engaged unit are engaged with each other, and the second engagement unit and the second engaged unit are not engaged with each other, the roller unit is movable to a second position at which the first engagement unit and the first engaged unit are engaged with each other, and the second engagement unit and the second engaged unit are engaged with each other. By the second engagement unit pressing the second engaged unit to move the roller unit from the first position to the second position, the second engaged unit moves to a position retracted from a second engagement unit movement locus.

9 Claims, 15 Drawing Sheets

(56) References Cited

U.S. PATENT DOCUMENTS

| | | | | |
|---|---|---|---|---|
| 2007/0145666 | A1* | 6/2007 | Nishikata | B65H 3/0638 271/18 |
| 2008/0128973 | A1* | 6/2008 | Hirose | B65H 3/5261 271/117 |
| 2011/0156342 | A1* | 6/2011 | Iino | B65H 3/0684 271/264 |

* cited by examiner

SHEET FEEDING DEVICE

BACKGROUND

Field

The present invention relates to a sheet feeding device that feeds sheets.

Description of the Related Art

Some typical electrophotographic image forming apparatuses form images onto sheets after conveying sheets to image forming units. Some of such image forming apparatuses include a sheet stacking cassette detachably attached to an image forming apparatus main body, and a sheet feeding device that automatically conveys a sheet stored in the sheet stacking cassette to an image forming unit.

Examples thereof includes the sheet feeding device including a feeding roller formed of a member such as rubber that has frictional force. In feeding a sheet, a feeding roller feeds the sheet to an image forming unit by being brought into contact with the sheet on the sheet stacking cassette to rotate.

In a case where rubber of a feeding roller of a feeding device having such a configuration has degraded due to, for example, abrasion, a decline in feeding performance might be caused. Thus, an operator, such as a user and a serviceperson, is to regularly replace a sheet feeding roller.

Japanese Patent No. 6849416 discusses a configuration in which a rotator unit including a sheet feeding roller is detachably attached to an apparatus main body in the replacement of the sheet feeding roller. When the rotator unit is attached to the apparatus main body, a rib and an arm of the rotator unit are engaged with each other, and then engagement with a drive shaft is performed. In engaging the rib with the arm of the rotator unit, the rotator unit is to be attached at a predetermined angle and predetermined orientation.

Japanese Patent Application Laid-Open No. 2018-080051 discusses a feeding device in which a feeding roller is held by a movable member urged by an urging unit.

In the configuration in which position adjustment is performed by engaging the rib and the arm of the rotator unit with each other and then engagement with the drive shaft is performed as discussed in Japanese Patent No. 6849416, the position adjustment of the rotator unit with respect to the drive shaft and an engagement operation of the rotator unit with respect to the arm are to be performed at the same time.

In the configuration in which a feeding roller (sheet feeding roller) is held by an urged movable member as discussed in Japanese Patent Application Laid-Open No. 2018-080051, the movable member is to be moved against the urging force of an urging member in the attachment and the detachment of the feeding roller. If urging force of the urging member is too strong, workability of the attachment and the detachment of the feeding roller decreases. In contrast, if the urging force is too weak, the feeding roller might move during a sheet feeding operation.

SUMMARY

According to an aspect of the present disclosure, a sheet feeding device includes an apparatus main body, a sheet storage unit configured to store a sheet, a roller unit including a roller configured to convey the sheet stored in the sheet storage unit, and having a first engagement unit and a second engagement unit, wherein the roller unit is attachable to and detachable from the apparatus main body, a first engaged unit included in the apparatus main body, and configured to engage with the first engagement unit, and a pressing arm included in the apparatus main body, including a second engaged unit configured to engage with the second engagement unit, and configured to press the roller unit in a direction of the sheet stored in the sheet storage unit, wherein, by being rotated about the first engagement unit from a first position at which the first engagement unit and the first engaged unit are engaged with each other, and the second engagement unit and the second engaged unit are not engaged with each other, the roller unit is movable to a second position at which the first engagement unit and the first engaged unit are engaged with each other, and the second engagement unit and the second engaged unit are engaged with each other, and wherein, by the second engagement unit pressing the second engaged unit to move the roller unit from the first position to the second position, the second engaged unit moves to a position retracted from a movement locus of the second engagement unit.

Further features of the present invention will become apparent from the following description of exemplary embodiments with reference to the attached drawings.

DESCRIPTION OF THE EMBODIMENTS

An image forming apparatus which is an example of an apparatus including a sheet feeding device according to an exemplary embodiment of the present invention will be described below. As an example of an image forming apparatus, an electrophotographic monochrome laser beam printer will be described with reference to the accompanying drawings. An image forming apparatus according to an exemplary embodiment of the present invention is applied to a laser beam printer; however, the present invention is not limited to this. An image forming apparatus according to an exemplary embodiment of the present invention may be applied to a copying machine or an inkjet printer. In the present exemplary embodiment, an exemplary embodiment of the present invention is applied to a sheet feeding unit of an image forming apparatus; however, the present invention is not limited to this. An exemplary embodiment of the present invention may be applied to a separate sheet feeding device such as an optional feeder that feeds sheets by being attached to an image forming apparatus.

<Overall Configuration of Image Forming Apparatus>

Figure 1:
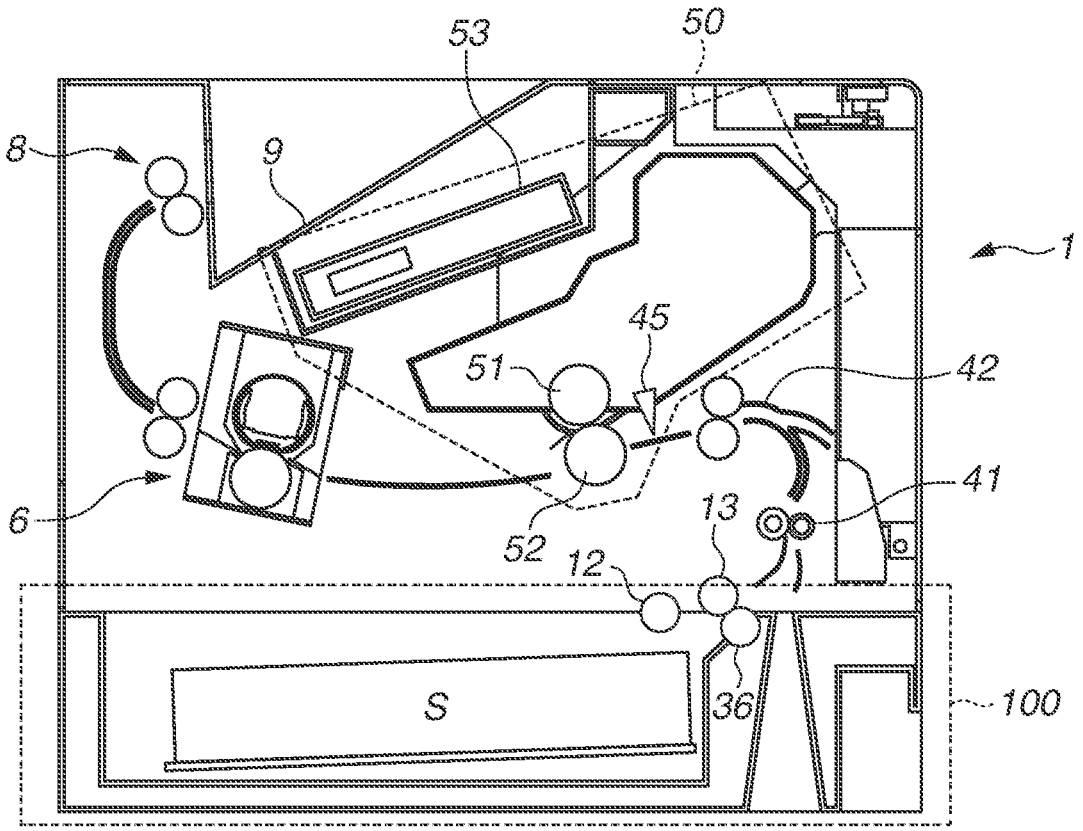
FIG. 1 is a schematic sectional diagram of an image forming apparatus according to a first exemplary embodiment.
Figure 2A:
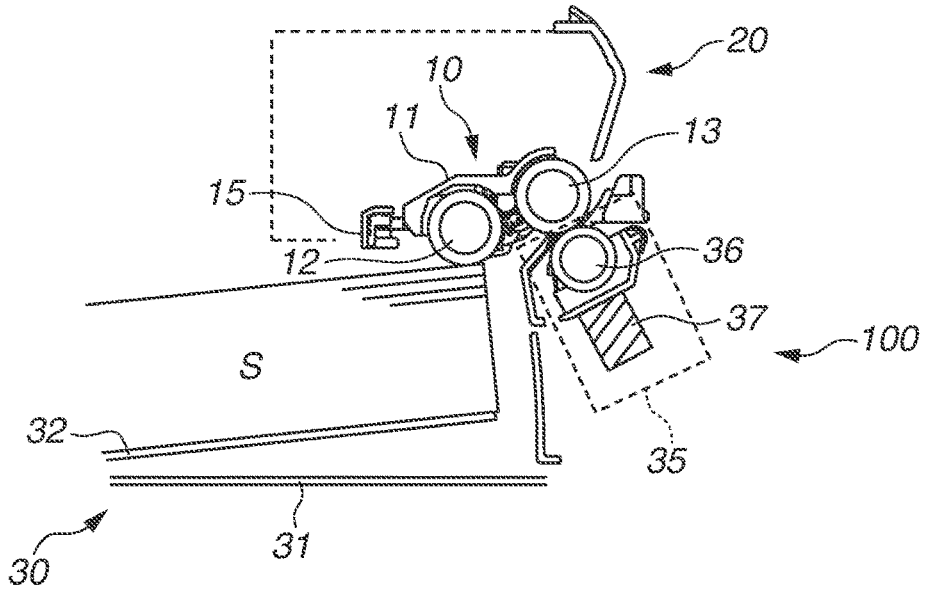
FIGS. 2A, 2B, and 2C are each a schematic sectional diagram illustrating a configuration of a sheet feeding device according to the first exemplary embodiment.
Figure 2B:
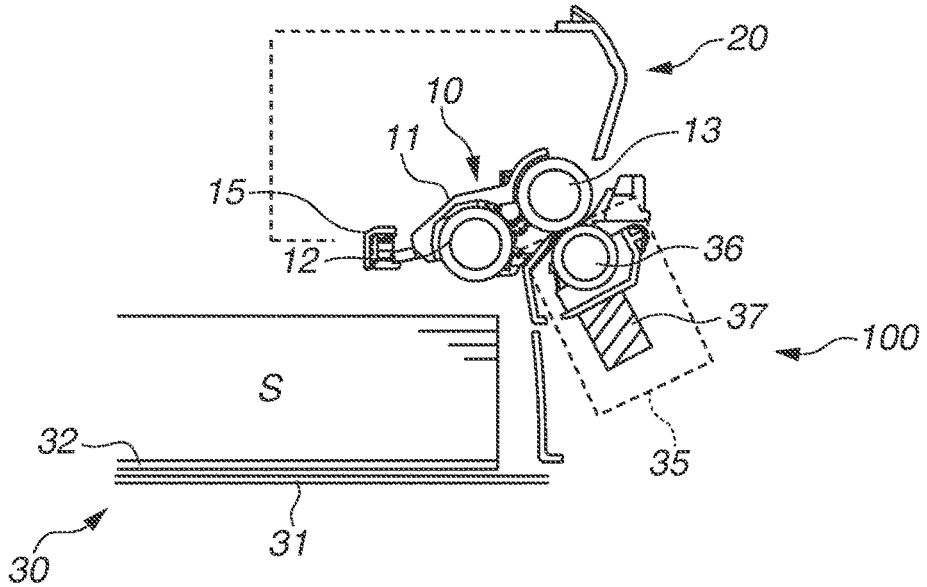
Figure 2C:
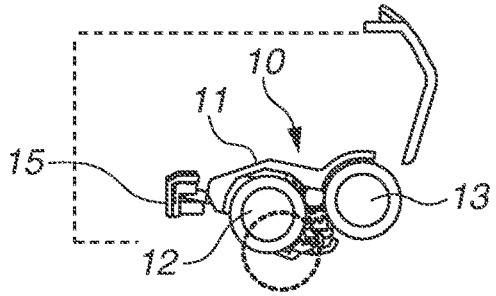

Initially, a schematic configuration of an image forming apparatus 1 will be described with reference to FIGS. 1, 2A, 2B, and 2C. FIG. 1 is a schematic sectional diagram of the image forming apparatus 1, and FIGS. 2A, 2B, and 2C are each a schematic sectional diagram illustrating a configuration of a sheet feeding device. FIG. 2A illustrates a state in which a sheet feeding cassette 30 is inserted into a sheet feeding device 100 (apparatus main body), and a stacking plate 32 is lifted up, FIG. 2B illustrates a state before the stacking plate 32 is lifted up, and FIG. 2C illustrates a state in which the sheet feeding cassette 30 is detached from the apparatus main body.

The image forming apparatus 1 forms an image with an electrophotographic recording method. The image forming apparatus 1 conveys a sheet S serving as a recording medium, to an image forming unit 50, transfers a toner image onto the sheet S, conveys the sheet S to a fixing unit 6, fixes the toner image onto the sheet S, and then discharges the sheet S to a discharge unit 9.

The image forming apparatus 1 includes the sheet feeding device 100, the image forming unit 50, and the fixing unit 6. The sheet feeding device 100 includes the sheet feeding cassette 30 and a sheet feeding roller unit 10, and conveys the sheets S to an intermediate conveyance roller pair 41 one by one from a sheet bundle stacked on the sheet feeding cassette 30.

The image forming unit 50 includes a photosensitive drum 51, a laser scanner 53 that forms an electrostatic latent image onto the photosensitive drum 51, and a transfer roller 52. By toner being supplied to the electrostatic latent image formed on the photosensitive drum 51, a toner image is formed, and the formed toner image is transferred onto the sheet S. The fixing unit 6 adds heat and applies pressure to the sheet S with the toner image transferred thereonto to fix the toner image onto the sheet S.

The sheets S are separated one by one from a sheet bundle stacked on the sheet feeding cassette 30 in the sheet feeding device 100, and are fed to the intermediate conveyance roller pair 41. The sheets S are then fed to the image forming unit 50 one by one via a registration roller pair 42. At this time, the image forming unit 50 starts to form a toner image onto the photosensitive drum 51 in accordance with a timing at which a registration sensor 45 arranged on the downstream side of the registration roller pair 42 detects a leading end of the sheet S. In such a manner, an image forming timing is adjusted in accordance with a timing at which the leading end of the sheet S passes through the registration sensor 45, so that a toner image is accurately transferred onto the sheet S in the image forming unit 50.

The sheet S having the toner image transferred thereonto in the image forming unit 50 is conveyed to the fixing unit 6, and the toner image is fixed onto the sheet S. The sheet S is then discharged to the discharge unit 9 by a discharge roller pair 8.

<Sheet Feeding Device>

Next, the sheet feeding device 100 according to the present exemplary embodiment will be described with reference to FIGS. 1, 2A, 2B, and 2C. The sheet feeding device 100 conveys the sheet S to the intermediate conveyance roller pair 41. The sheet feeding device 100 includes a sheet feeding unit 20 attached to the image forming apparatus 1, a sheet feeding drive unit (not illustrated), and the sheet feeding cassette 30 detachable from the sheet feeding device 100 in a right direction in FIGS. 1, 2A, 2B, and 2C.

The sheet feeding unit 20 includes the sheet feeding roller unit 10 and a pressing arm 15. In the sheet feeding roller unit 10, a pickup roller 12 serving as a second roller and a feed roller 13 serving as a first roller are rotatably held by a roller holder 11. The sheet feeding roller unit 10 is detachably attached to the sheet feeding unit 20. That is, it can also be said that the sheet feeding roller unit 10 is detachably attached to the sheet feeding device 100. In a state of being attached to the sheet feeding unit 20, the sheet feeding roller unit 10 is held on the sheet feeding unit 20 to be pivotable about a rotational axis of the feed roller 13. Furthermore, the sheet feeding roller unit 10 is urged against the sheet S by a feeding pressure urging member 16 to be described below, via the pressing arm 15.

In performing a sheet feeding operation, the pickup roller 12 is pressed against the sheet S on the stacking plate 32 by predetermined urging force (feeding pressure) (refer to FIG. 2A). In the present exemplary embodiment, when the sheet feeding cassette 30 is detached from the sheet feeding device 100, the pickup roller 12 is swung by the pressing arm 15 about the rotational axis of the feed roller 13 in a direction away from the sheet S (FIG. 2C). A holding configuration of the sheet feeding roller unit 10 with respect to the sheet feeding unit 20 and an attaching/detaching operation of the sheet feeding roller unit 10 with respect to the sheet feeding unit 20 will be described in detail below.

The stacking plate 32 on which the sheets S are stacked in a cassette tray 31 serving as a sheet storage unit is swingably provided on the sheet feeding cassette 30. Then, if the sheet feeding cassette 30 is inserted into the sheet feeding device 100, the stacking plate 32 is swung (lifted up) toward the pickup roller 12 by a drive source (not illustrated).

The sheet feeding cassette 30 is provided with a separation unit 35. The separation unit 35 includes a separation roller 36 and a separation spring 37. A small torque limiter is embedded in the separation roller 36, and braking at a predetermined torque is applied in a rotational direction. In a state where the sheet feeding cassette 30 is attached to the main body, the separation unit 35 is arranged in such a manner that the separation roller 36 is at a counter position of the feed roller 13, and the separation roller 36 is pressed against the feed roller 13 by the urging force of the separation spring 37.

By providing the separation unit 35 on the sheet feeding cassette 30, the detachment of the sheet feeding cassette 30 from the sheet feeding device 100 exposes the sheet feeding roller unit 10 (FIG. 2C). Thus, the sheet feeding roller unit 10 has high visibility in its replacement, thus providing accessibility of the sheet feeding roller unit 10.

In the present exemplary embodiment, a portion of the sheet feeding device 100 that excludes the sheet feeding roller unit 10 and the sheet feeding cassette 30 can be referred to as an apparatus main body of the sheet feeding device 100. The pressing arm 15, the feeding pressure urging member 16 to be described below, a slide shaft 22, a slide bearing 70, a feed shaft 21, a feed bearing 23, and a slide spring 24 are included in the apparatus main body of the sheet feeding device 100. The apparatus main body of the sheet feeding device 100 may include a portion equivalent to the sheet feeding cassette 30.

<Sheet Feeding Operation>

Next, a sheet feeding operation of the sheet feeding device 100 will be described. If the sheet feeding cassette 30 is inserted into the sheet feeding device 100, the stacking plate 32 moves upward, and the pickup roller 12 comes into contact with the uppermost sheet S in the cassette tray 31 serving as a sheet storage unit (FIG. 2A). At this time, the pickup roller 12 comes into contact with the sheet S at a predetermined pressure via the pressing arm 15 as described above. After that, the pickup roller 12 and the feed roller 13 receive drive force from a sheet feeding drive unit (not illustrated), and both rotate in a counterclockwise direction in FIGS. 2A, 2B, and 2C.

If the pickup roller 12 starts to rotate, the sheet S starts to move in the right direction in FIGS. 2A, 2B, and 2C due to friction between the pickup roller 12 and the sheet S. After that, the sheet S reaches a separation nip portion formed by the feed roller 13 and the separation roller 36. The separation nip portion has a function of separating the sheets S and conveying only one sheet S toward the downstream side in a sheet conveyance direction when two or more sheets S are fed to the separation nip portion by the pickup roller 12.

As described above, a torque limiter is embedded in the separation roller 36, and torque functioning as resistance force is applied in a direction opposite to the conveyance direction of the sheet S. The torque is set in such a manner that the separation roller 36 rotates in accordance with the rotation of the feed roller 13 when only one sheet S is present at the separation nip portion, and the separation roller 36 stops if two sheets S enter the separation nip portion. It is therefore possible to separate one sheet S from the other sheets S at the separation nip portion, and convey the separated sheet S toward the downstream side in the conveyance direction of the sheet S. The sheet S is then conveyed to the intermediate conveyance roller pair 41 by the rotation of the pickup roller 12 and the feed roller 13.

<Configuration of Sheet Feeding Roller Unit>

Figure 3A:
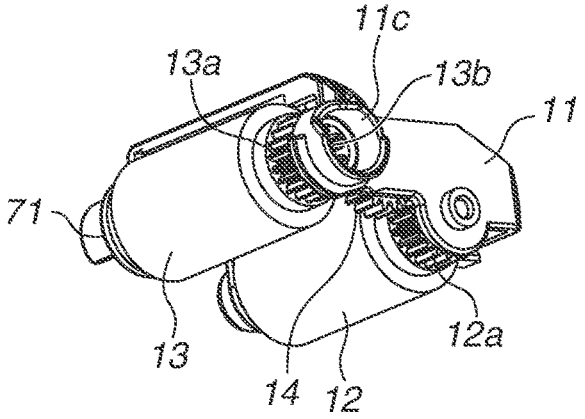
FIGS. 3A and 3B are each a schematic perspective diagram of a sheet feeding roller unit according to the first exemplary embodiment.
Figure 3B:
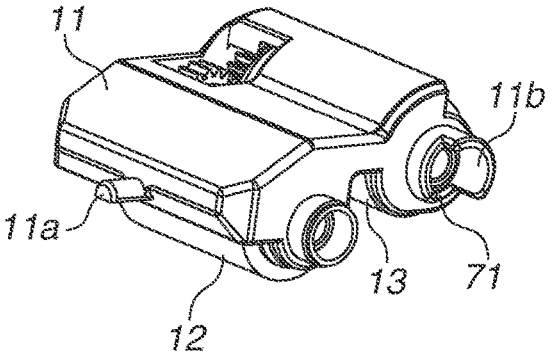

Next, the sheet feeding roller unit 10 will be described with reference to FIGS. 2A, 2B, 2C, 3A, and 3B. FIGS. 3A and 3B are each a schematic perspective diagram of the sheet feeding roller unit 10. As illustrated in FIGS. 3A and 3C, the sheet feeding roller unit 10 includes the pickup roller 12, the feed roller 13, the roller holder 11, and an idler gear 14.

The pickup roller 12 and the feed roller 13 are rotatably held by the roller holder 11. The pickup roller 12 and the feed roller 13 are respectively provided with gear portions 12*a* and 13*a*. The gear portions 12*a* and 13*a* of the respective rollers are coupled by the idler gear 14. The idler gear 14 is also rotatably held by the roller holder 11.

The feed roller 13 is provided with a coupling hole 13*b* and a slide shaft engagement unit 71. A coupling portion 21*b* of the feed shaft 21 to be described below is inserted into and coupled to the coupling hole 13*b*. By receiving rotary drive from the feed shaft 21, drive force is input to the feed roller 13, and the pickup roller 12 is driven in tandem via the idler gear 14.

Next, the shape of the roller holder 11 will be described. The roller holder 11 is provided with an engagement boss 11*a*, a cam portion 11*b*, and a bearing engagement unit 11*c*. In a state in which the sheet feeding roller unit 10 is attached to the apparatus main body, the engagement boss 11*a* serving as a second engagement unit is engaged with the pressing arm 15. When the sheet feeding cassette 30 is detached from the sheet feeding device 100, the pickup roller 12 pivots in a direction away from the sheet S.

The cam portion 11*b* comes into contact with a rib 22*b* of the slide shaft 22 serving as a holding member to be described below, and controls an orientation of the sheet feeding roller unit 10 that has been attached to the sheet feeding device 100. The functions of the cam portion 11*b* and the rib 22*b* of the slide shaft 22 will be described in detail below.

<Configuration of Sheet Feeding Unit>

Figure 4A:
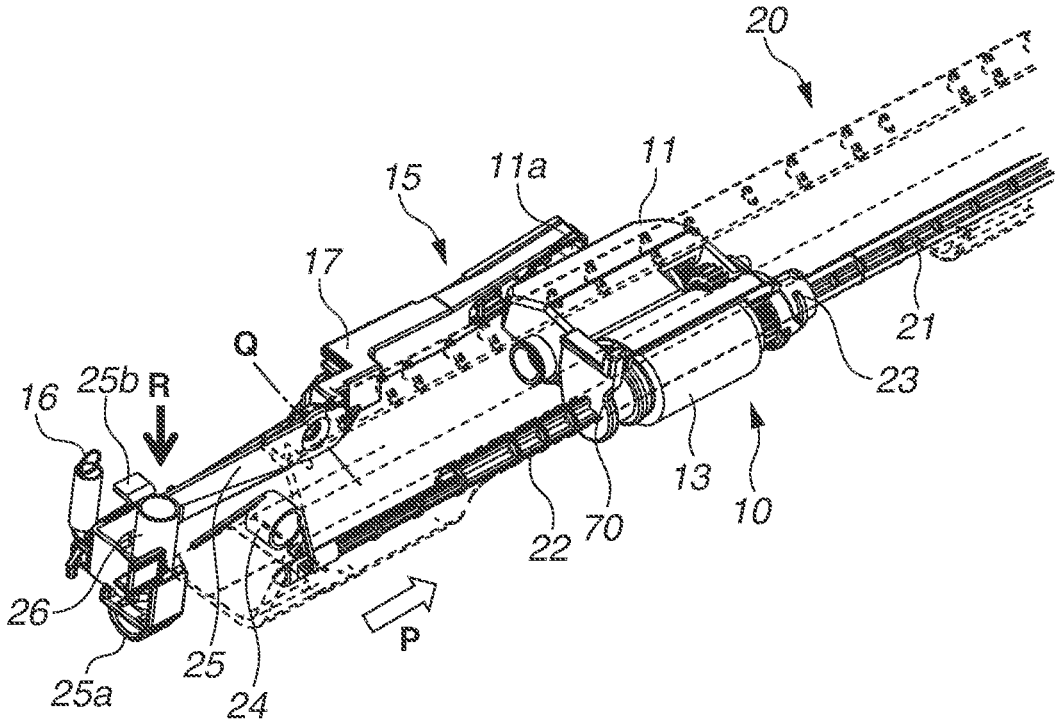
FIGS. 4A and 4B are each a schematic perspective diagram illustrating a configuration of a sheet feeding unit according to the first exemplary embodiment.
Figure 4B:
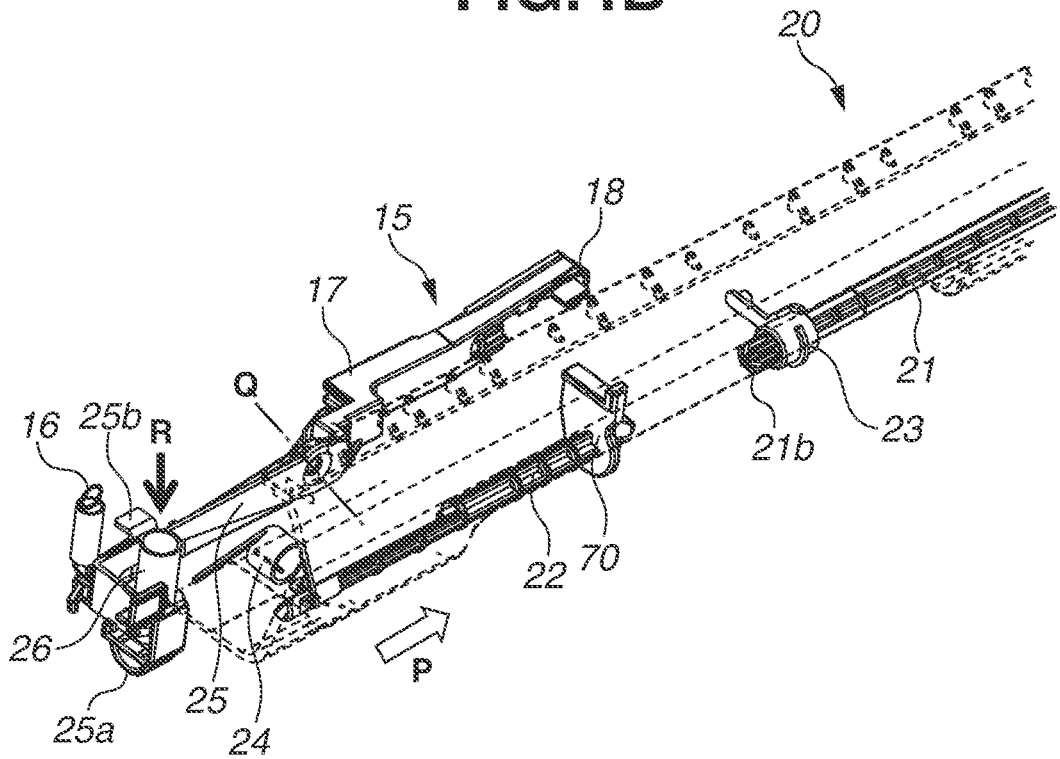
Figure 5:
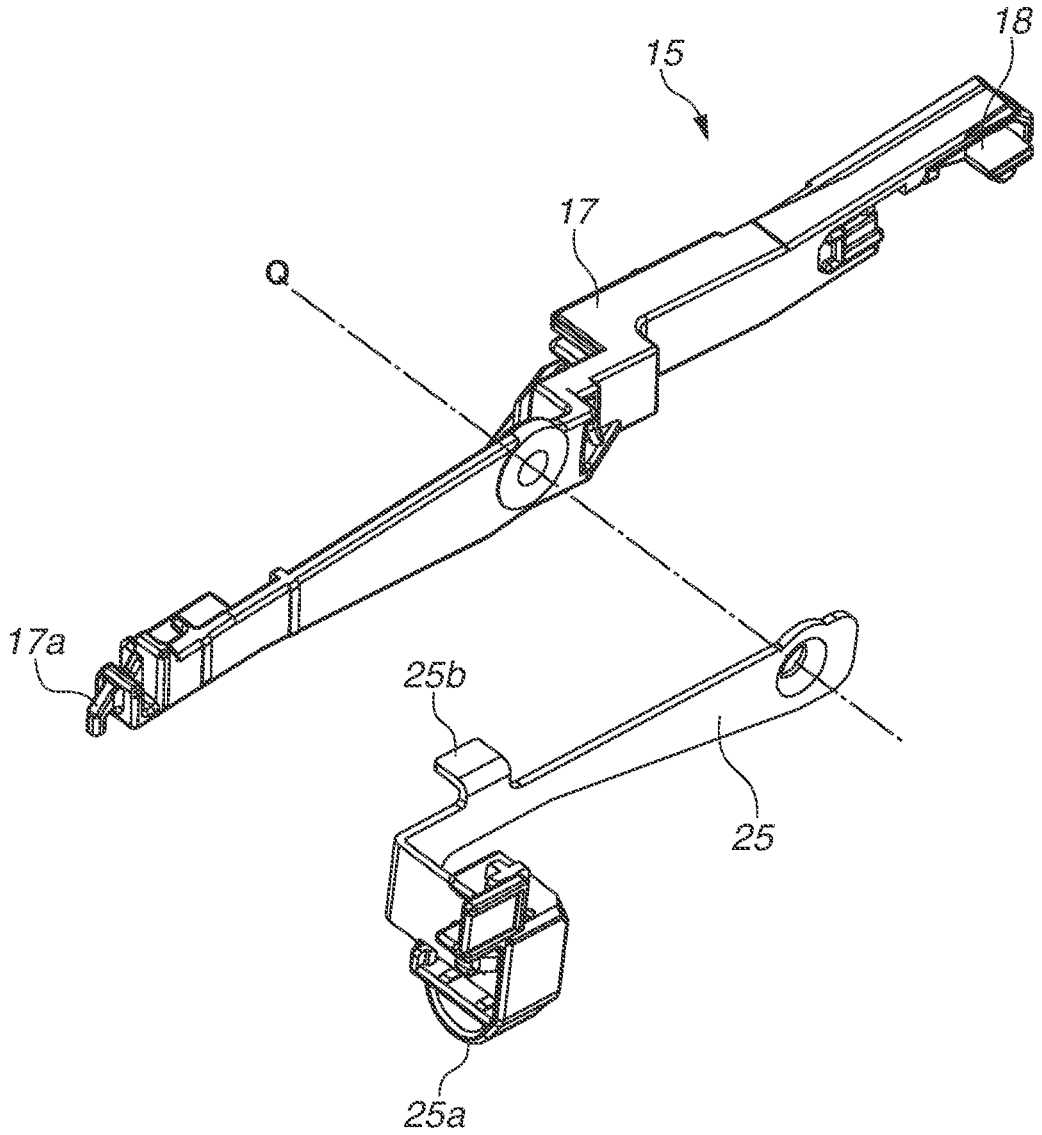
FIG. 5 is a diagram illustrating a relationship between a pressing arm and a separation arm according to the first exemplary embodiment.

Next, the sheet feeding unit 20 to which the sheet feeding roller unit 10 is attached will be described with reference to FIGS. 4A, 4B, and 5. FIGS. 4A and 4B are each a schematic perspective diagram illustrating a configuration of the sheet feeding unit 20. FIG. 4A illustrates a state in which the sheet feeding roller unit 10 is attached and FIG. 4B illustrates a state in which the sheet feeding roller unit 10 is detached. FIG. 5 is a diagram illustrating a relationship between the pressing arm 15 and a separation arm 25, and is an exploded perspective diagram of the pressing arm 15 and the separation arm 25.

The sheet feeding unit 20 includes the feed shaft 21, the slide shaft 22, the feed bearing 23, the slide bearing 70, and the pressing arm 15. In the present exemplary embodiment, the slide bearing 70 is integrated with the slide shaft 22, and can be said to be a part of the slide shaft 22. The sheet feeding roller unit 10 engages with the slide shaft 22 in a portion in which the slide bearing 70 is arranged. In other words, the slide shaft 22 and the slide bearing 70 both have functions as a holding member.

In a rotational axis direction of the feed roller 13, the feed shaft 21 and the feed bearing 23 are arranged on one end side (first end side) of the feed roller 13, and the slide shaft 22 and slide bearing 70 are arranged on the other end side (second end side) of the feed roller 13. In the present exemplary embodiment, the feed shaft 21, the slide shaft 22, and the slide bearing 70 are arranged to overlap a rotational axis line of the feed roller 13.

The feed bearing 23 engages with the bearing engagement unit 11*c*. The coupling portion 21*b* at the leading end of the feed shaft 21 is inserted into the above-described coupling hole 13*b* of the feed roller 13, and transmits rotary drive force from a sheet feeding drive unit (not illustrated) to the feed roller 13. The slide shaft 22 is arranged on second end side of the feed roller 13, and is urged by the slide spring 24 serving as a shaft urging member, in the rotational axis direction of the feed roller 13 (P direction in FIGS. 4A and 4B). The slide shaft 22 engages with the slide shaft engagement unit 71.

This urging force holds the sheet feeding roller unit 10 between the feed bearing 23 and the slide bearing 70, and the sheet feeding roller is supported to be swingable about the rotational axis of the feed roller 13. A direction in which the slide spring 24 urges the slide shaft 22, and a direction in which the slide shaft 22 moves in such a manner as to engage with the sheet feeding roller unit 10 will be referred to as a first direction. In other words, the slide spring 24 urges the slide shaft 22 in the first direction.

The coupling hole 13*b*, the slide shaft engagement unit 71, and the bearing engagement unit 11*c* have functions as a first engagement unit of the sheet feeding roller unit 10. The slide shaft 22 including the slide bearing 70 and the feed shaft 21 including the feed bearing 23 have functions as a first engaged unit.

The pressing arm 15 has a function of controlling a phase of the swingably-supported sheet feeding roller unit 10, and urging the pickup roller 12 against the sheet S in a sheet feeding operation. In other words, the pressing arm 15 has a function of pressing the sheet feeding roller unit 10 toward a direction of sheets stored in the cassette tray 31. The pressing arm 15 is supported to be swingable about a fulcrum Q. One end side of the pressing arm 15 engages with the engagement boss 11*a* of the sheet feeding roller unit 10. Another end side of the pressing arm 15 is urged by the feeding pressure urging member 16 serving as a tension coil spring. The force of the feeding pressure urging member 16 functions as urging force (feeding pressure) of the pickup roller 12 on the sheet S. The configuration of the pressing arm 15 and functions of each component will be described in detail below.

In the present exemplary embodiment, a separation mechanism of rotating the sheet feeding roller unit 10 in a direction away from the sheet S in conjunction with a detachment operation of the sheet feeding cassette 30 from the apparatus main body is provided. Regarding the configuration, a state in which the sheet feeding cassette 30 is detached from the apparatus main body will be initially described.

The pressing arm 15 is supported on the apparatus main body to be pivotable about a pivot axis Q. The pressing arm 15 is urged by the feeding pressure urging member 16 upward in a vertical direction at one end distant from the sheet feeding roller unit 10 in a width direction of the sheet S that is orthogonal to the conveyance direction of the sheet S. At one end close to the sheet feeding roller unit 10 in the width direction of the sheet S, a cap 18 serving as a second engaged unit that engages with the engagement boss 11*a* serving as a second engagement unit is arranged. If the feeding pressure urging member 16 pulls the pressing arm 15 upward in a state in which the engagement boss 11*a* and the cap 18 engage with each other, the cap 18 positioned on the opposite side across the pivot axis Q moves downward.

Thus, if one end of the pressing arm 15 that is distant from the sheet feeding roller unit 10 moves upward in a state in which the sheet feeding cassette 30 is attached to the apparatus main body, the pickup roller 12 moves downward. In a state in which the sheet feeding cassette 30 is detached from the apparatus main body, the pickup roller 12 pivots in a direction away from the sheet S, as illustrated in FIG. 2C, which will be described in detail below.

A configuration of the separation arm 25 for moving the pickup roller 12 upward in the vertical direction in conjunction with a detachment operation of the sheet feeding cassette 30 from the apparatus main body will be described. The separation arm 25 is urged by a separation spring 26 downward in the vertical direction at one end distant from the sheet feeding roller unit 10 in the width direction of the sheet S. One end close to the sheet feeding roller unit 10 in the width direction of the sheet S is supported on the apparatus main body on the pivot axis Q of the pressing arm 15, and the separation arm 25 can also pivot about the pivot axis Q independently of the pressing arm 15. Upper end portions of the feeding pressure urging member 16 and the separation spring 26 in the vertical direction engage with the apparatus main body.

The separation arm 25 is provided with an arm engagement unit 25*b* that comes into contact with the pressing arm 15 and controls the pivoting of the pressing arm 15. The arm engagement unit 25*b* is arranged to overlap a movement locus of the pressing arm 15 when the pressing arm 15 pivots about the pivot axis Q. With this configuration, an end portion of the pressing arm 15 that is distant from the sheet feeding roller unit 10 in the width direction of the sheet S is configured so as not to move upward in the vertical direction with respect to an end portion of the separation arm 25 that is distant from the sheet feeding roller unit 10.

In the present exemplary embodiment, urging force of the separation spring 26 is set larger than urging force of the feeding pressure urging member 16. Thus, in a case where the sheet feeding cassette 30 is detached form the apparatus main body, the separation arm 25 is urged by the separation spring 26, and an urged end portion moves downward in the vertical direction. By the arm engagement unit 25*b* urging the pressing arm 15 at the same time, an end portion of the pressing arm 15 that is urged by the feeding pressure urging member 16 moves downward in contradiction to a force acting in the direction in which the feeding pressure urging member 16 urges the pressing arm 15 to pivot. With such a configuration, in a state in which the sheet feeding cassette 30 is detached from the apparatus main body, the pickup roller 12 is moved and held upward in the vertical direction.

Next, a relationship between the pressing arm 15 and the separation arm 25 in a state in which the sheet feeding cassette 30 is attached to the apparatus main body will be described. The separation arm 25 is provided with a cassette contact portion 25*a*.

In response to the sheet feeding cassette 30 being attached the apparatus main body, a contact portion (not illustrated) provided on the sheet feeding cassette 30 and the cassette contact portion 25*a* of the separation arm 25 come into contact with each other, and the cassette contact portion 25*a* is lifted upward in accordance with the attachment of the sheet feeding cassette 30. With this configuration, an end portion of the separation arm 25 that is distant from the sheet feeding roller unit 10 moves upward in the vertical direction.

As a result, the arm engagement unit 25*b* stops urging the pressing arm 15 downward in the vertical direction. Thus, an end portion of the pressing arm 15 that is distant from the sheet feeding roller unit 10 also pivots upward due to the feeding pressure urging member 16, and the pickup roller 12 pivots downward. The pickup roller 12 is then lowered up to a predetermined position and stops. In response to the stacking plate 32 pivoting due to the attachment of the sheet feeding cassette 30 to the apparatus main body, the pickup roller 12 and the sheet S come into contact with each other, and the sheet S is urged at a predetermined pressure.

<Configuration of Pressing Arm>

Figure 6A:
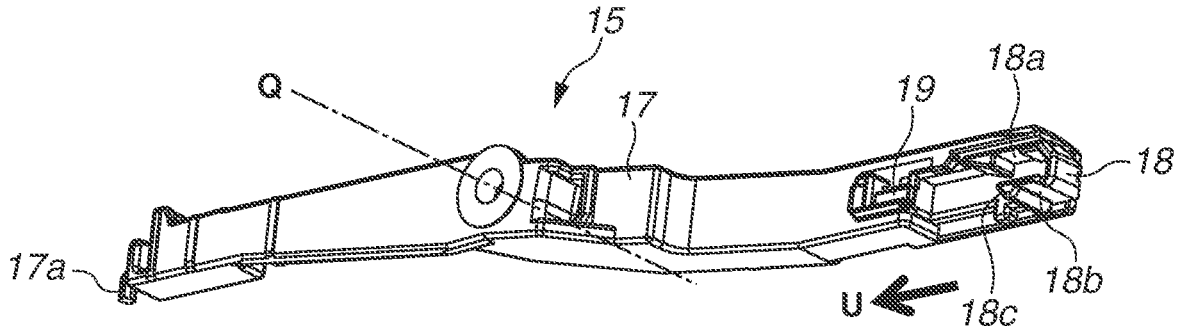
FIGS. 6A and 6B are each an enlarged perspective diagram of the pressing arm according to the first exemplary embodiment.
Figure 6B:
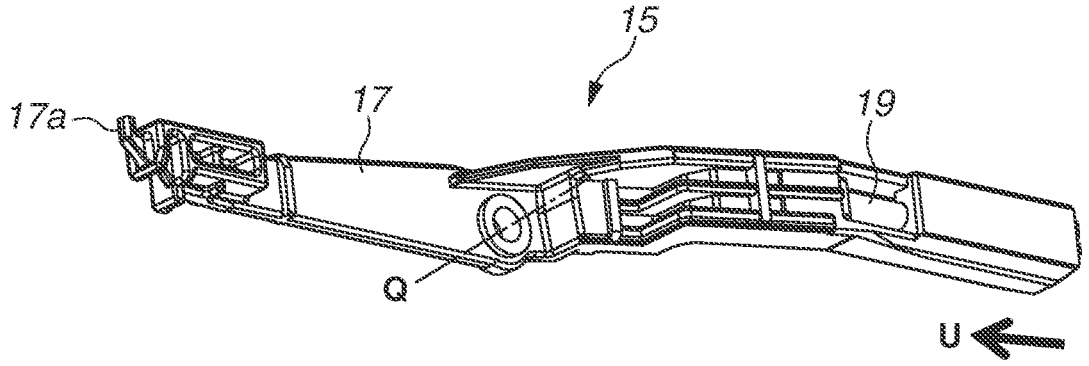

Next, a configuration of a pressing arm, which is a characteristic configuration of the present invention, will be described with reference to FIGS. 6A, 6B, 7A, 7B, 7C, 7D, and 7E. FIGS. 6A and 6B are each an enlarged perspective diagram of the pressing arm 15. FIGS. 7A, 7B, 7C, 7D, and 7E are each a schematic sectional diagram illustrating an attachment procedure of the sheet feeding roller unit 10. The pressing arm 15 includes an arm portion 17, the cap 18 (second engaged unit), and a cap spring 19. Since the arm portion 17 is pivotable about the pivot axis Q, the entire pressing arm 15 is pivotable about the pivot axis Q.

On one end side of the pivot axis Q of the arm portion 17, a spring hook portion 17*a* to which the feeding pressure urging member 16 is to be attached is provided. On this one end side of the pivot axis Q of the arm portion 17 is a portion to be pressed by the arm engagement unit 25*b*.

The cap 18 is attached to the other end of the pivot axis Q of the arm portion 17. In other words, the arm portion 17 includes an attachment portion for attaching the cap 18. The cap 18 engages with the engagement boss 11*a* of the sheet feeding roller unit 10. The cap 18 is slidably attached to the arm portion 17 in a state of being urged in a U direction in FIGS. 6A and 6B by the cap spring 19 serving as an urging member. In addition, the cap 18 is arranged to be movable with respect to the arm portion 17 in a direction opposite to the U direction against urging force of the cap spring 19. As illustrated in FIGS. 7A, 7B, 7C, 7D, and 7E, the cap 18 is provided with a slope portion 18*c*, and a recessed portion 18*a* serving as a regulation groove.

The slope portion 18*c* has a function of generating force that moves the cap 18 in a direction opposite to the U direction in FIGS. 6A and 6B by being pressed by the engagement boss 11*a* of the sheet feeding roller unit 10 in an attachment operation of the sheet feeding roller unit 10, which will be described below. The recessed portion 18*a* has regulation surfaces 18*d*, and the regulation surfaces 18*d* have an effect when the pickup roller 12 is in contact with the sheet S, and has a function of regulating the movement of the sheet feeding roller unit 10 in the axis direction. The function of the recessed portion 18*a* will be described in detail below.

<Attachment of Sheet Feeding Roller Unit 10>

Figure 7A:
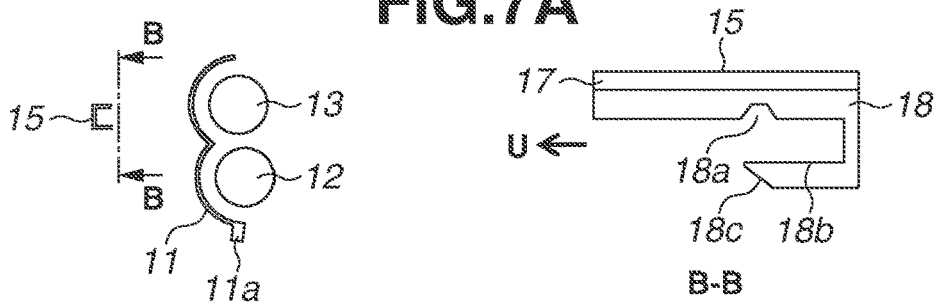
FIGS. 7A, 7B, 7C, 7D, and 7E are each a schematic sectional diagram illustrating an attachment procedure of the sheet feeding roller unit according to the first exemplary embodiment.
Figure 7B:
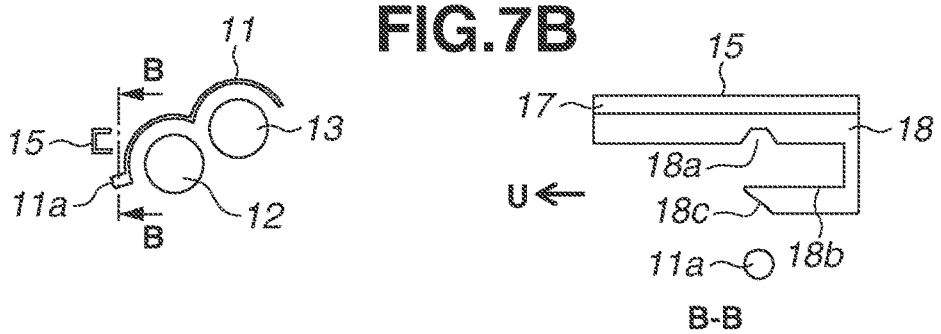
Figure 7C:
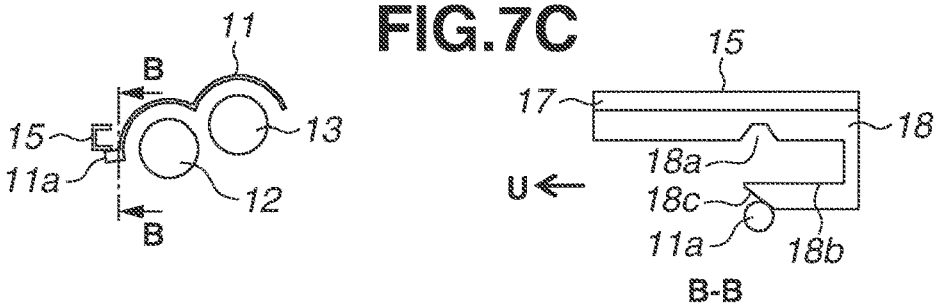
Figure 7D:
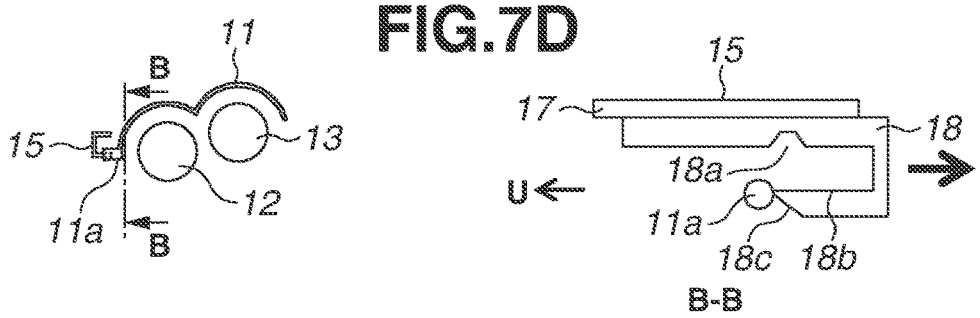
Figure 7E:
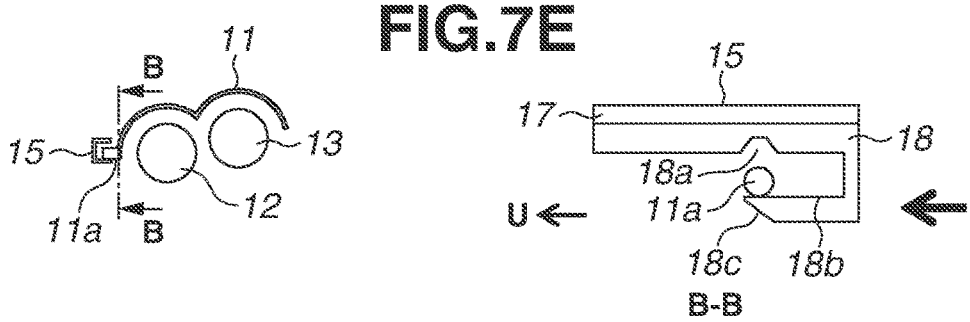

Next, an attachment operation of the sheet feeding roller unit 10 with respect to the sheet feeding unit 20 will be described with reference to FIGS. 7A, 7B, 7C, 7D, and 7E. In FIGS. 7A, 7B, 7C, 7D, and 7E, the orientation of the sheet feeding roller unit 10 is illustrated on the left side and a relationship between the engagement boss 11*a* and the pressing arm 15 is illustrated on the right side. FIG. 7A illustrates a state in which the sheet feeding roller unit 10 is held between the slide bearing 70 and the feed bearing 23, and is not engaged with the pressing arm 15. FIG. 7B illustrates an orientation of the sheet feeding roller unit 10 during pivoting, and illustrates a state after the sheet feeding cassette 30 is inserted into the sheet feeding device 100 in a first state to be described below. FIG. 7C illustrates a state in which the sheet feeding roller unit 10 is in contact with the pressing arm 15 after being caused to pivot. FIG. 7D illustrates a state in which the cap 18 is retracted. FIG. 7E illustrates a state when the attachment of the sheet feeding roller unit 10 has been completed.

Initially, an attachment operation of the sheet feeding roller unit 10 causes the sheet feeding roller unit 10 to engage with the slide shaft 22, the feed bearing 23, and the feed shaft 21 in a certain phase. After that, by causing the sheet feeding roller unit 10 to pivot about the rotational axis of the feed roller 13, the sheet feeding roller unit 10 and the pressing arm 15 are engaged with each other.

An operator initially moves the slide shaft 22 in a direction of resisting a slide spring pressure f1. The feed bearing 23 and the bearing engagement unit 11*c* then engage with each other, and the coupling portion 21*b* of the feed shaft 21 and the coupling hole 13*b* of the feed roller 13 engage with each other. The slide shaft 22 including the slide bearing 70 moves due to the slide spring pressure f1, and engages with the slide shaft engagement unit 71. Thus, the sheet feeding roller unit 10 is attached to a position between the slide bearing 70 and the feed bearing 23. At this time, a phase (orientation, slope) of the sheet feeding roller unit 10 may be freely set (FIG. 7A). Here, the direction of the slide spring pressure f1 is regarded as first direction. A direction opposite to the first direction is regarded as a second direction.

A state of the sheet feeding roller unit 10 in which the sheet feeding roller unit 10 is attached to a position between the slide bearing 70 and the feed bearing 23, and the engagement boss 11*a* and the pressing arm 15 are not engaged with each other is regarded as a first state. In the first state, the feed bearing 23 and the bearing engagement unit 11*c* are engaged with each other, the coupling portion 21*b* of the feed shaft 21 and the coupling hole 13*b* of the feed roller 13 are engaged with each other, and the slide shaft 22 including the slide bearing 70 is engaged with the slide shaft engagement unit 71. The engagement boss 11*a* and the pressing arm 15 are not engaged with each other. After that, if the sheet feeding roller unit 10 is caused to pivot about the rotational axis of the feed roller 13 toward the pressing arm 15, the engagement boss 11*a* of the sheet feeding roller unit 10 comes into contact with the cap 18 of the pressing arm 15 (FIGS. 7B to 7C).

In the first state, the sheet feeding roller unit 10 is pressed toward the feed bearing 23 by the slide spring pressure f1 of the slide spring 24 that urges the slide shaft 22. In this state, in the rotational axis direction of the feed roller 13 (parallel to the rotational axis direction of the pickup roller 12), the movement of the sheet feeding roller unit 10 is regulated by the slide spring 24. Thus, in the rotational axis direction of the feed roller 13, the position of the engagement boss 11*a* overlaps the positions of the slope portion 18*c* and the recessed portion 18*a* of the cap 18.

As described above, the cap 18 is urged in the U direction. The cap 18 is provided with the slope portion 18*c*. If the engagement boss 11*a* presses the slope portion 18*c* as illustrated in FIG. 7C, the cap 18 receives force in the right direction in FIG. 7D as illustrated in FIG. 7D, and moves in the right direction. In other words, the slope portion 18*c* is inclined in such a manner that, when the engagement boss 11*a* moves to engage with the cap 18, the cap 18 retracts in a direction opposite to the direction in which the cap 18 is urged. The movement direction of the cap 18 at this time is a direction intersecting with a rotational direction in which the pressing arm 15 rotates about the pivot axis Q (same as the rotational direction of the arm portion 17). The cap 18 moves in a direction away from the pivot axis Q, in a direction intersecting with the pivot axis Q.

A position at which the cap 18 is not retracted (position in FIG. 7A) is regarded as a steady-state position. The cap spring 19 urges the cap 18 to be positioned at the steady-state position. In the direction intersecting with the pivot axis Q, the cap spring 19 urges the cap 18 in a direction in which the cap 18 approaches the pivot axis Q. Consequently, the cap 18 moves in a direction approaching the pivot axis Q, and returns to the steady-state position. When the cap 18 is at the steady-state position, the cap spring 19 continues to urge the cap 18, and positioning is performed by a part (contact portion) of the cap 18 coming into contact with the arm portion 17.

Thus, by rotating the sheet feeding roller unit 10 toward the pressing arm 15 from the state illustrated in FIG. 7C, the cap 18 retracts in a direction opposite to the U direction (FIG. 7D). The position of the retracted cap 18 is regarded as a retracted position. Furthermore, by the sheet feeding roller unit 10 rotating toward the pressing arm 15, the engagement boss 11*a* gets into the cap 18, and the cap 18 returns to the steady-state position and engages with the pressing arm 15 (FIG. 7E).

As described above, the state in which the feed bearing 23 and the bearing engagement unit 11*c* are engaged with each other, the coupling portion 21*b* and the coupling hole 13*b* are engaged with each other, the slide shaft 22 and the slide shaft engagement unit 71 are engaged with each other, and the engagement boss 11*a* and the pressing arm 15 are not engaged with each other is regarded as the first state. In other words, the state of the sheet feeding roller unit 10 in which the first engagement unit and the first engaged unit are engaged with each other, and the second engagement unit and the second engaged unit are not engaged with each other is regarded as the first state. The position of the sheet feeding roller unit 10 is regarded as a first position. Furthermore, a position of the sheet feeding roller unit 10 at which the first engagement unit and the first engaged unit are engaged with each other, and the second engagement unit and the second engaged unit are also engaged with each other is regarded as a second position.

As described above, the sheet feeding roller unit 10 is movable from the first position to the second position by rotating about the coupling hole 13*b*, the slide shaft engagement unit 71, and the bearing engagement unit 11*c*. The second engaged unit is positioned at the steady-state position when the sheet feeding roller unit 10 is at the second position. By the second engagement unit pressing the second engaged unit to move the sheet feeding roller unit 10 from the first position to the second position, the second engaged unit swings to a retracted position at which the second engaged unit is retracted from a movement locus of the second engagement unit.

In such a manner, performing the attachment of the sheet feeding roller unit 10 through two steps including the engagement with the slide bearing 70 and the feed bearing 23, and the engagement with the pressing arm 15, allows an operator to concentrate on each work, thus improving workability in the replacement of the sheet feeding roller unit 10.

Nevertheless, in the case of performing the attachment of the sheet feeding roller unit 10 through two steps in this manner, it is desirable that the sheet feeding roller unit 10 is automatically attached even if the second step is not performed. In the present exemplary embodiment, in a case where the sheet feeding cassette 30 is inserted in a state in which only the engagement between the sheet feeding roller unit 10, and the feed shaft 21 including the feed bearing 23 and the slide shaft 22 including the slide bearing 70 is performed, the sheet feeding roller unit 10 engages with the pressing arm 15.

Figure 8A:
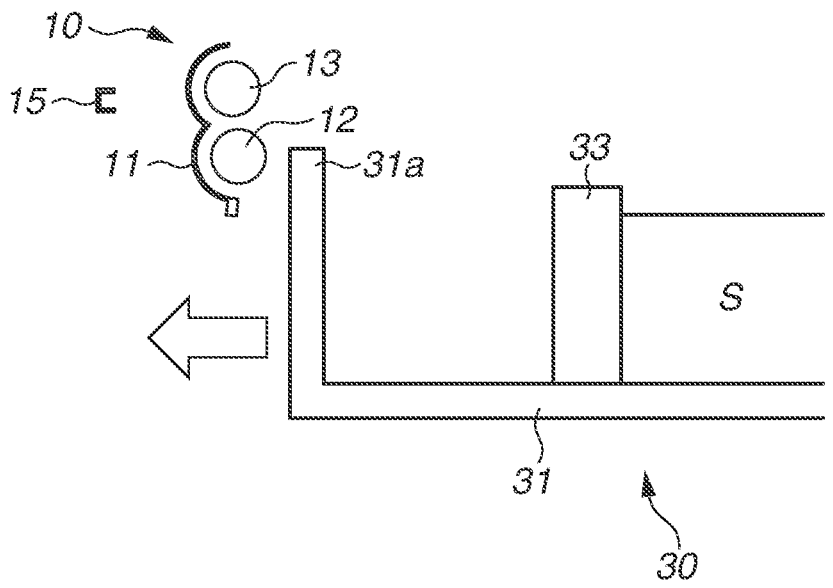
FIGS. 8A and 8B are each a schematic diagram illustrating a motion and an orientation of the sheet feeding roller unit according to the first exemplary embodiment that are caused when a sheet feeding cassette is inserted into an apparatus main body in a state in which the sheet feeding roller unit is supported on a slide shaft.
Figure 8B:
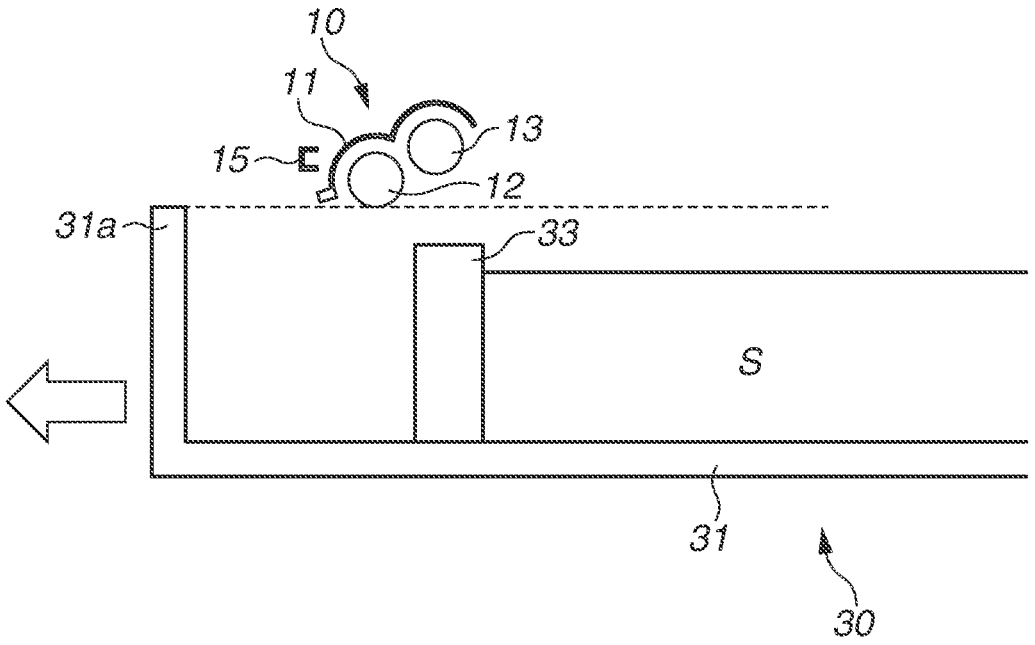
Figure 9B:
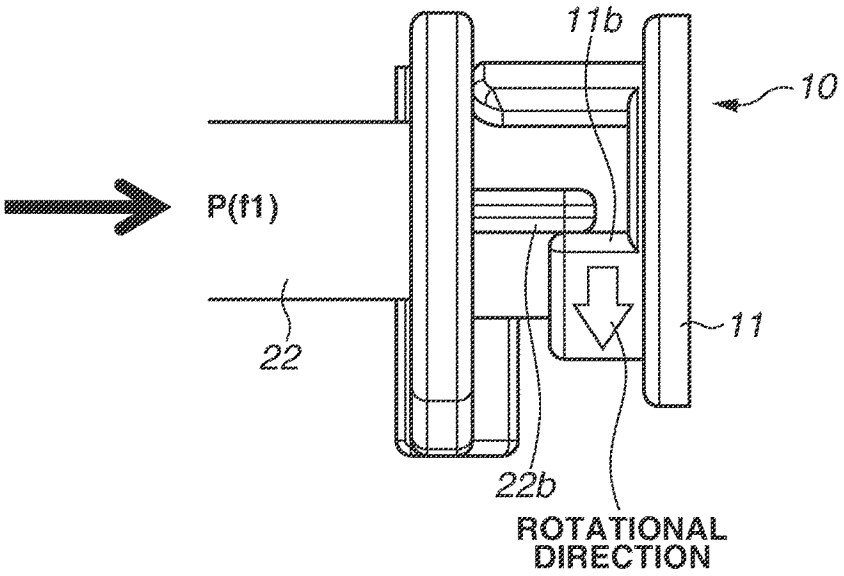
FIGS. 9A and 9B are each an enlarged diagram illustrating a relationship between the slide shaft and the sheet feeding roller unit according to the first exemplary embodiment.
Figure 9A:
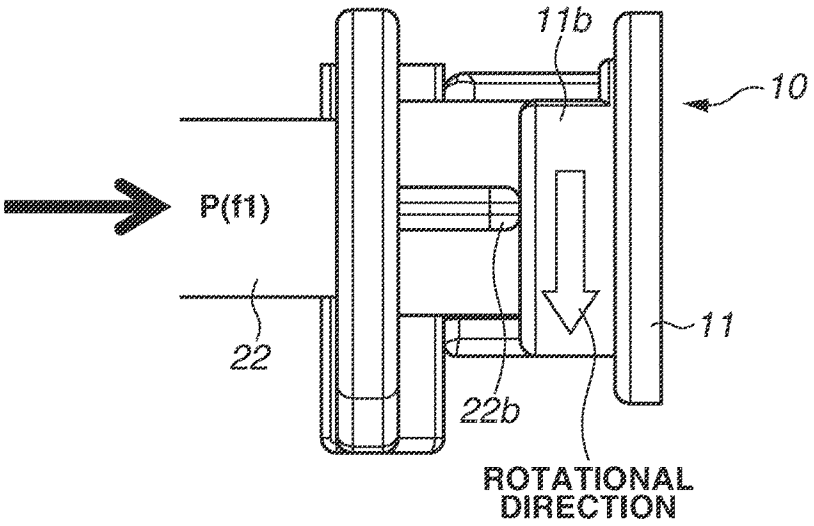

The details of the configuration will be described with reference to FIGS. 7A, 7B, 7C, 7D, 7E, 8A, 8B, 9A, and 9B. FIGS. 8A and 8B are each a schematic diagram illustrating a motion and an orientation of the sheet feeding roller unit 10 in inserting the sheet feeding cassette 30 into the sheet feeding device 100 in a state in which the sheet feeding roller unit 10 is supported on the slide shaft 22. FIGS. 8A and 8B illustrate a state during insertion of the sheet feeding cassette 30. The orientations of the sheet feeding roller unit 10 in FIGS. 8A and 8B respectively correspond to the orientations in FIGS. 7A and 7B. FIGS. 9A and 9B are each an enlarged diagram illustrating a relationship between the slide shaft 22 and the sheet feeding roller unit 10 in the states illustrated in FIGS. 8A and 8B, and illustrate an X portion in FIG. 10A in an enlarged manner.

A case where an operator attaches the sheet feeding roller unit 10 to the apparatus main body in such a manner that the sheet feeding roller unit 10 engages with the slide shaft 22 including the slide bearing 70 and the feed shaft 21 including the feed bearing 23 as illustrated in FIG. 7A is assumed. In this state, the operator inserts the sheet feeding cassette 30 from the right direction in FIGS. 8A and 8B. The cassette tray 31 of the sheet feeding cassette 30 is provided with a lift-up portion 31*a*. During the insertion of the sheet feeding cassette 30 into the sheet feeding device 100, the lift-up portion 31*a* comes into contact with the sheet feeding roller unit 10, and rotates the sheet feeding roller unit 10 about the rotational axis of the feed roller 13 in a clockwise direction in FIGS. 8A and 8B.

The lift-up portion 31*a* is provided to extend to the highest position in the vertical direction of a portion passing below the sheet feeding roller unit 10 during the insertion of the sheet feeding cassette 30. For example, the lift-up portion 31*a* is formable on a wall on the conveyance direction upstream side of the sheet feeding cassette 30 or a regulation plate 33 for sheets. If the lift-up portion 31*a* passes below the sheet feeding roller unit 10 in the first state, the sheet feeding roller unit 10 is held at the position illustrated in FIG. 8B. The frictional force of the slide shaft engagement unit 71 and the slide bearing 70 that is brought about by the slide spring pressure f1 may be used for the holding.

In the present exemplary embodiment, by the cam portion 11*b* and the rib 22*b* of the slide shaft 22 engaging with each other as illustrated in FIGS. 9A and 9B, the orientation is prevented from returning from the orientation in FIG. 8B to the orientation in FIG. 8A. This configuration will be described in detail.

When the sheet feeding roller unit 10 is in the state in FIG. 8A, a relationship between the slide shaft 22 and the cam portion 11*b* of the sheet feeding roller unit 10 becomes the state in FIG. 9A. The slide shaft 22 is urged in a P direction in FIGS. 9A and 9B by the slide spring pressure f1. The lift-up portion 31*a* of the sheet feeding cassette 30 rotates the sheet feeding roller unit 10 in a rotational direction in FIGS. 9A and 9B during the insertion of the sheet feeding cassette 30, and the state transitions from the state in FIG. 9A to the state in FIG. 9B.

When the sheet feeding cassette 30 is inserted and the state transitions from the state in FIG. 8A to the state in FIG. 8B, a relationship between the slide shaft 22 and the cam portion 11*b* of the sheet feeding roller unit 10 becomes the state in FIG. 9B.

Since the slide shaft 22 is urged in the P direction, in a case where the sheet feeding roller unit 10 rotates in a direction opposite to the rotational direction, the cam portion 11*b* gets caught on the rib 22*b* of the slide shaft 22, so that returning from the state in FIG. 9B to the state in FIG. 9A is prevented. In other words, the sheet feeding roller unit 10 is held at a position between the first position and the second position by the rib 22*b*. This position is regarded as a third position.

If the insertion of the sheet feeding cassette 30 into the sheet feeding device 100 is completed, the stacking plate 32 moves upward, and the sheet S and the pickup roller 12 come into contact with each other. The sheet S then causes the sheet feeding roller unit 10 to pivot to the second position, through the processes illustrated in FIGS. 7C to 7E.

At this time, force to be added by the engagement boss 11*a* to the slope portion 18*c* is reaction force that the pickup roller 12 presses the sheet S, and is generated by the feeding pressure urging member 16. The force added by the engagement boss 11*a* to the slope portion 18*c* urges the cap 18 from the steady-state position toward the retracted position against the urging force of the cap spring 19. Here, the cap spring 19 urges the cap 18 from the retracted position toward the steady-state position. In a case where urging force of the cap spring 19 is larger than force exerted by the engagement boss 11*a* urging the cap 18 toward the retracted position, the engagement boss 11*a* cannot engage with the cap 18.

Thus, force of the cap spring 19 is set small, and force of the cap spring 19 is set in such a manner that, if the feeding pressure urging member 16 causes the pickup roller 12 to press the sheet S, the cap 18 moves to the retracted position.

In such a manner, when the sheet feeding roller unit 10 is in the first state, the sheet feeding cassette 30 is inserted and the stacking plate 32 is moved upward, thus automatically engaging the engagement boss 11*a* with the cap 18, in the present exemplary embodiment. The sheet feeding roller unit 10 consequently enters the second state.

As described above, according to the present exemplary embodiment, the sheet feeding roller unit 10 is attached to the slide shaft 22 including the slide bearing 70 and the feed shaft 21 including the feed bearing 23 in a certain phase, and then the sheet feeding roller unit 10 is caused to pivot toward the pressing arm 15, thus performing the attachment of the sheet feeding roller unit 10. To achieve this, the slope portion 18*c* of the pressing arm 15 and the engagement boss 11*a* of the sheet feeding roller unit 10 are configured to come into contact with each other during the pivoting of the sheet feeding roller unit 10. Furthermore, the cap 18 is configured to retract if the engagement boss 11*a* presses the slope portion 18*c*, and the cap 18 is configured to return to the original position if the engagement boss 11*a* is attached to the pressing arm 15.

Thus, only by an operator causing the sheet feeding roller unit 10 to pivot after attaching the sheet feeding roller unit 10 to the slide shaft 22, the feed bearing 23, and the feed shaft 21, it is possible to engage the sheet feeding roller unit 10 with the pressing arm 15. In other words, the attachment of the sheet feeding roller unit 10 is easily performed. The present exemplary embodiment can attain this function with a retracting configuration of an engagement unit (the cap 18) of the pressing arm 15 and the sheet feeding roller unit 10. It is therefore possible to enhance usability in replacement of the sheet feeding roller unit 10 with lower cost and a smaller space.

<Detachment of Sheet Feeding Roller Unit 10>

Figure 10A:
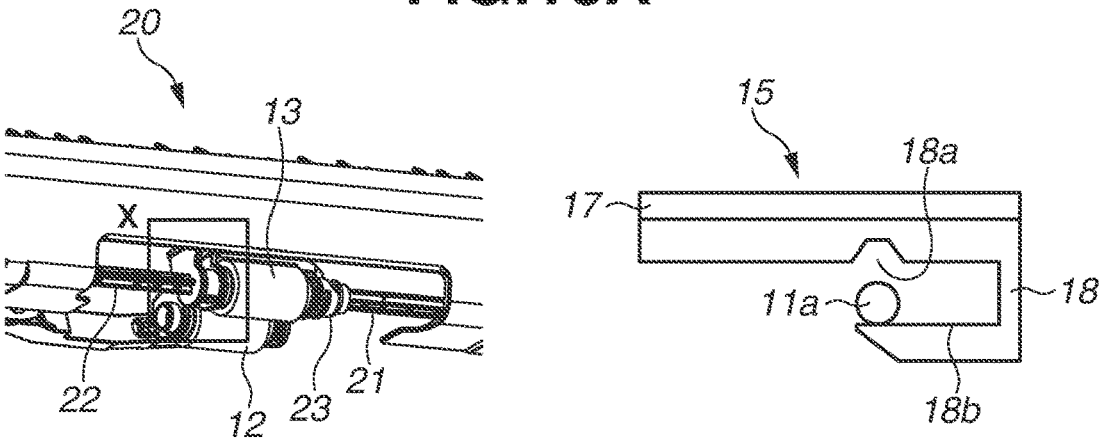
FIGS. 10A, 10B, and 10C are each a schematic perspective diagram illustrating a detachment operation of the sheet feeding roller unit according to the first exemplary embodiment, and schematic sectional diagrams corresponding thereto.
Figure 10B:
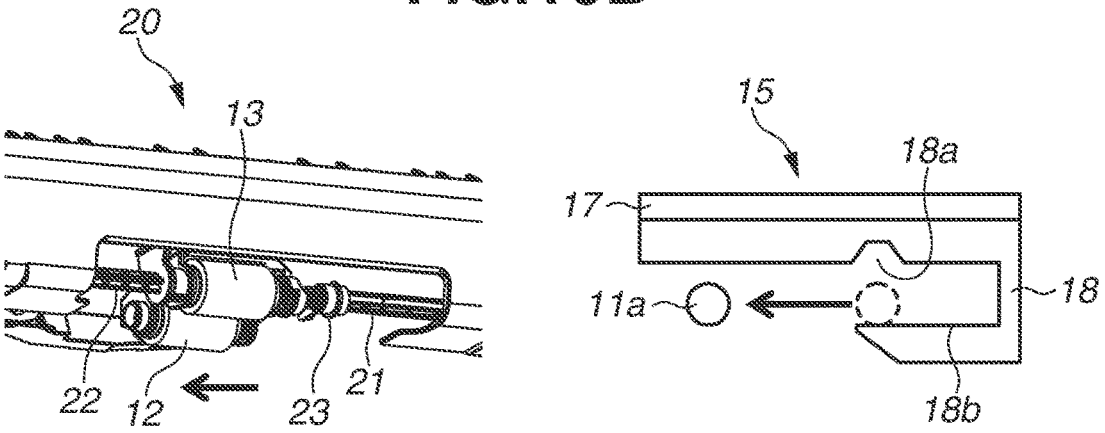
Figure 10C:
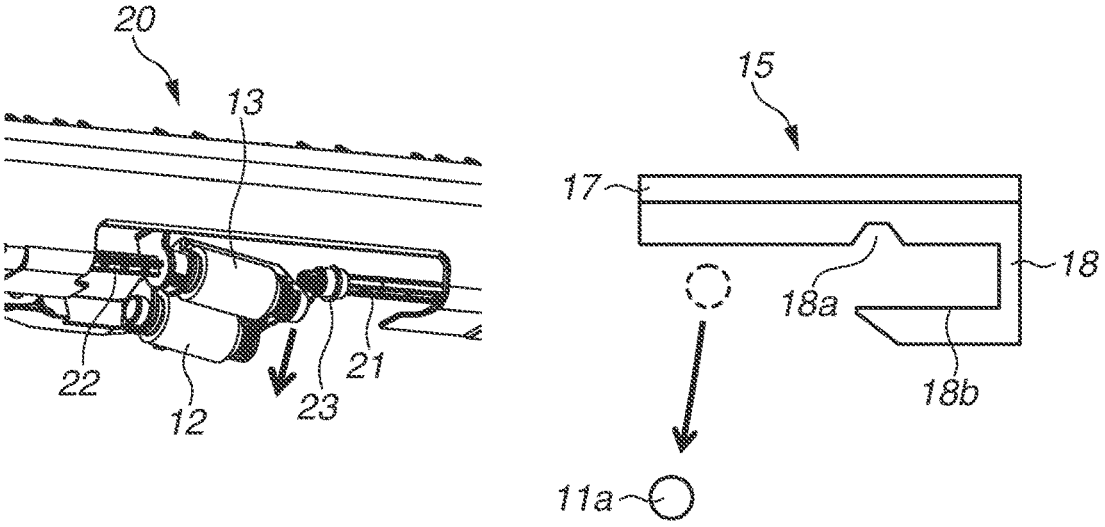

Next, a detachment operation of the sheet feeding roller unit 10 in the present exemplary embodiment will be described with reference to FIGS. 10A, 10B, and 10C. FIGS. 10A, 10B, and 10C are each a schematic perspective diagram illustrating a detachment operation of the sheet feeding roller unit 10 and schematic sectional diagrams corresponding thereto. The schematic sectional diagrams in FIGS. 10A, 10B, and 10C are sectional diagrams taken along a B-B cross section in FIGS. 7A, 7B, 7C, 7D, and 7E. FIG. 10A illustrates a state in which the sheet feeding roller unit 10 is attached, and FIGS. 10B and 10C illustrate a process in which the sheet feeding roller unit 10 is detached from the sheet feeding unit 20.

In the present exemplary embodiment, the sheet feeding roller unit 10 is detachable by being accessed from the conveyance direction downstream direction of the sheet S (the right direction in FIGS. 1, 2A, 2B, and 2C). When an operator, such as a user and a serviceperson, detaches the sheet feeding roller unit 10 from the sheet feeding device 100, the operator detaches the sheet feeding cassette 30 from the main body.

The sheet feeding roller unit 10 is then exposed and becomes accessible to an operator (FIG. 10A). At this time, the sheet feeding roller unit 10 is held by the slide bearing 70, the feed bearing 23, and the cap 18. The operator grips any position of the sheet feeding roller unit 10, and moves the sheet feeding roller unit 10 in an arrow direction in FIG. 10B (second direction) against the pressure of the slide spring 24 of the slide shaft 22. At this time, the cap 18 is at the steady-state position.

The engagement of the coupling hole 13*b* and the feed shaft 21, and the engagement of the bearing engagement unit 11*c* and the feed bearing 23 are then cancelled, and the engagement boss 11*a* also moves in an arrow direction (leftward) (FIG. 10B). At this time, as illustrated in the sectional diagram in FIG. 10B, the engagement boss 11*a* is at a position disengaged from the cap 18 of the pressing arm 15.

After that, causing the sheet feeding roller unit 10 to pivot in an arrow direction in FIG. 10C (direction intersecting with the rotational axis line of the feed roller 13) cancels the engagement of the sheet feeding roller unit 10 and the pressing arm 15 is also cancelled. Then, cancelling the engagement of the slide shaft 22 and the sheet feeding roller unit 10 allows the sheet feeding roller unit 10 to be detached. In other words, moving the sheet feeding roller unit 10 in the second direction makes it possible to detach the sheet feeding roller unit 10 from the apparatus main body.

An attachment operation of the sheet feeding roller unit 10 is also performable in a reverse procedure of the above-described detachment operation. Nevertheless, in the reverse procedure of the detachment operation, the slide shaft 22 is to be attached while the orientation (slope) of the sheet feeding roller unit 10 is controlled for the engagement of the sheet feeding roller unit 10 and the pressing arm 15.

<Urging Force of Slide Spring 24>

In a slide operation of the sheet feeding roller unit 10, the operator is to move the sheet feeding roller unit 10 against the pressure of the slide spring 24 urging the slide shaft 22. It is therefore desirable that the urging force of the slide spring 24 is low from the aspect of the operability in the attachment and detachment of the sheet feeding roller unit 10. Nevertheless, the sheet feeding roller unit 10 is to be held with fixed force in such a manner that the sheet feeding roller unit 10 does not move due to skew of the sheet S, an operation of the sheet feeding roller unit 10, or jam handling in the conveyance direction downstream. In order to achieve both of the above-described conflicting matters, a characteristic configuration is provided in the cap 18 of the pressing arm 15 in the present exemplary embodiment.

Figure 11A:
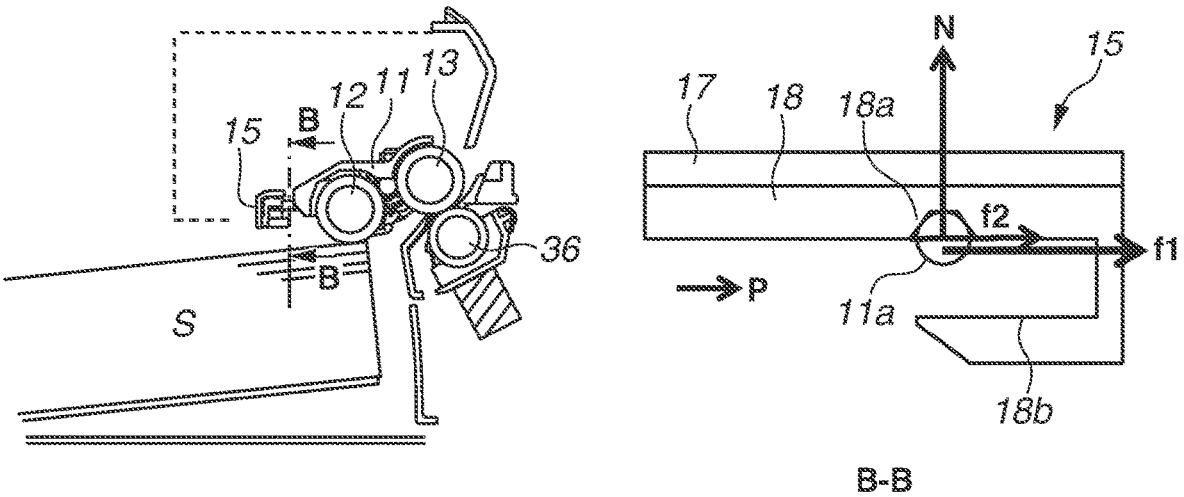
FIGS. 11A and 11B are each a schematic sectional diagram illustrating an orientation of the sheet feeding roller unit according to the first exemplary embodiment and an engaged state of an engagement boss of the sheet feeding roller unit and a cap of the pressing arm.
Figure 11B:
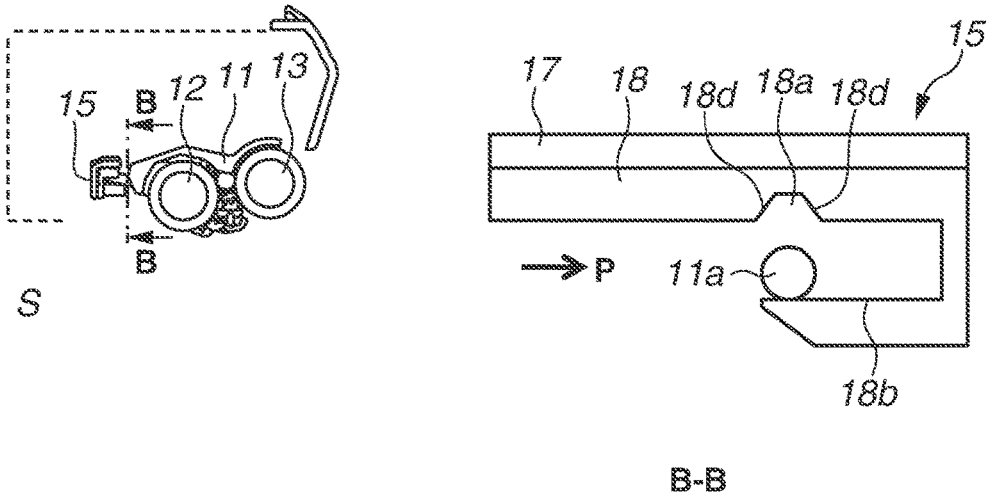

Such a configuration will be described with reference to FIGS. 11A and 11B. FIGS. 11A and 11B are each a schematic sectional diagram illustrating an orientation of the sheet feeding roller unit 10 and an engaged state of the engagement boss 11*a* of the sheet feeding roller unit 10 and the cap 18 of the pressing arm 15. FIG. 11A illustrates a state in a sheet feeding operation and FIG. 11B illustrates a state in which the sheet feeding cassette 30 is detached, and respectively correspond to FIGS. 2A and 2C.

As described above, in a sheet feeding operation or jam handling, fixed holding force is to be applied to prevent the sheet feeding roller unit 10 from moving in a detachment direction. FIG. 11A illustrates a state in which the sheet feeding cassette 30 is inserted into the main body, and the pickup roller 12 is in pressure contact with the sheet S. The sheet feeding roller unit 10 is held by the pressure of the slide spring 24 in the P direction in the right schematic diagram, and the sheet feeding roller unit 10 is detached by being moved in the left direction in FIG. 11A. In the present invention, when the pickup roller 12 is in pressure contact with the sheet S as illustrated in FIG. 11A, the engagement boss 11*a* of the sheet feeding roller unit 10 fits into the recessed portion 18*a* of the cap 18 of the pressing arm 15.

In such a manner, the position of the engagement boss 11*a* is adjusted so that the engagement boss 11*a* fits into the recessed portion 18*a* when the engagement boss 11*a* moves upward in the vertical direction by the pickup roller 12 and the sheet S being brought into contact with each other. The position of the recessed portion 18*a* is adjusted by the contact portion of the cap 18 being brought into contact with the arm portion 17.

In a state in which the pickup roller 12 and the sheet S in contact, a feeding pressure N generated by the feeding pressure urging member 16 acts on the engagement boss 11*a*. Thus, when the sheet feeding roller unit 10 is moved in the left direction in FIG. 11A, the engagement boss 11*a* and the regulation surfaces 18*d* come into contact with each other, so that force f2 for the engagement boss 11*a* to climb over the recessed portion 18*a* is to be applied in addition to the slide spring pressure f1. The slide spring pressure f1 and a recess shape are determined in such a manner that the slide spring pressure f1+the force f2 become holding force sufficient in a sheet feeding operation and jam handling. Specifically, the regulation surfaces 18*d* are inclined with respect to an axis line direction of the feed roller 13 and the vertical direction.

FIG. 11B illustrates a state in which the sheet feeding cassette 30 is detached from the sheet feeding device 100. When an operator, such as a user and a serviceperson, replaces the sheet feeding roller unit 10, the operator performs the replacement in this state. At this time, as described above, the sheet feeding roller unit 10 is lifted up by the pressing arm 15 by the function of a separation mechanism. Thus, the engagement boss 11*a* becomes in a state of being separated from the recessed portion 18*a* (state in which the engagement boss 11*a* is disengaged from the recessed portion 18*a* and the regulation surfaces 18*d*) as illustrated in FIG. 11B. Thus, to move the sheet feeding roller unit 10 in the left direction in FIG. 11B, the sheet feeding roller unit 10 is movable only by force against the slide spring pressure f1.

In other words, the regulation surfaces 18*d* regulate the movement of the engagement boss 1 lain an axis line direction by coming into contact with the engagement boss 11*a* when the pickup roller 12 is urged in the direction of the sheet S by the pressing arm 15. The engagement boss 11*a* and the recessed portion 18*a* are not in contact when the pressing arm 15 is not urged in the direction of the sheet S. The regulation surfaces 18*d* cancel the regulation when the pickup roller 12 is not urged in the direction of the sheet S by the pressing arm 15. With this configuration, it is possible to achieve both ensuring of a holding force for the sheet feeding roller unit 10 in usage and reduction of an operational force in detachment.

If the movement of the sheet feeding roller unit 10 in a sheet feeding operation or jam handling is regulated only with the slide spring pressure f1, the slide spring pressure f1 is to be increased. According to the configuration of the present exemplary embodiment, the recessed portion 18*a* enables the movement of the sheet feeding roller unit 10 to be regulated in a sheet feeding operation or jam handling (when the pickup roller 12 is in contact with the sheet S).

It is therefore possible to reduce the slide spring pressure f1 as compared with the case of regulating the movement of the sheet feeding roller unit 10 in a sheet feeding operation or jam handling only with the slide spring pressure f1.

In the present exemplary embodiment, a resistive shape in usage is realized by providing the engagement boss 11*a* in the sheet feeding roller unit 10, and providing the recessed portion 18*a* in the pressing arm 15. The present invention is not limited to this, and the configuration is not limited as long as the resistive shape that acts in the movement direction in a pressured-applied state is present. For example, the resistive shape can also be realized by a configuration in which a recess is provided in a sheet feeding roller unit and a protrusion is provided on a pressing arm. A width of the recessed portion 18*a* in the rotational axis direction may be larger than a width of the engagement boss 11*a*, and the engagement boss 11*a* may be configured to come into contact with the recessed portion 18*a* when moving in a first direction by a predetermined distance.

According to the present exemplary embodiment, if the sheet feeding roller unit 10 comes into pressure contact with the sheet S, the engagement boss 11*a* of the sheet feeding roller unit 10 fits into the recessed portion 18*a* of the pressing arm 15, and when the sheet feeding roller unit 10 is detached, the engagement boss 11*a* is disengaged from the recessed portion 18*a*. Thus, in sheet feeding, holding force of the sheet feeding roller unit 10 is ensured with resistance force of the recessed portion 18*a*. It is therefore possible to lower the pressure f1 of the slide spring 24. It is consequently possible to reduce operational force of a slide shaft in the replacement of the sheet feeding roller unit 10.

A second exemplary embodiment of the present invention will be described below. In the above-described first exemplary embodiment, a configuration is employed in which the engagement boss 11*a* (protrusion) is provided on the sheet feeding roller unit 10 and the recessed portion 18*a* is provided on the pressing arm 15. The configuration in which the sheet feeding roller unit 10 is caused to pivot to come into contact with the pressing arm 15 to retract the cap 18 has been described. In the present exemplary embodiment, a description of a configuration will be provided in which an engagement boss 115*a* (protrusion) serving as a second engaged unit is provided on a pressing arm 115, and an engagement slit 111*a* serving as a second engagement unit is provided on a roller holder 111 of a sheet feeding roller unit 110, with reference to FIGS. 12A, 12B, 12C, and 13. Furthermore, a configuration in which a recessed portion 111*c* in the engagement slit 111*a* on the sheet feeding roller unit 110 is provided will be described.

Figure 12A:
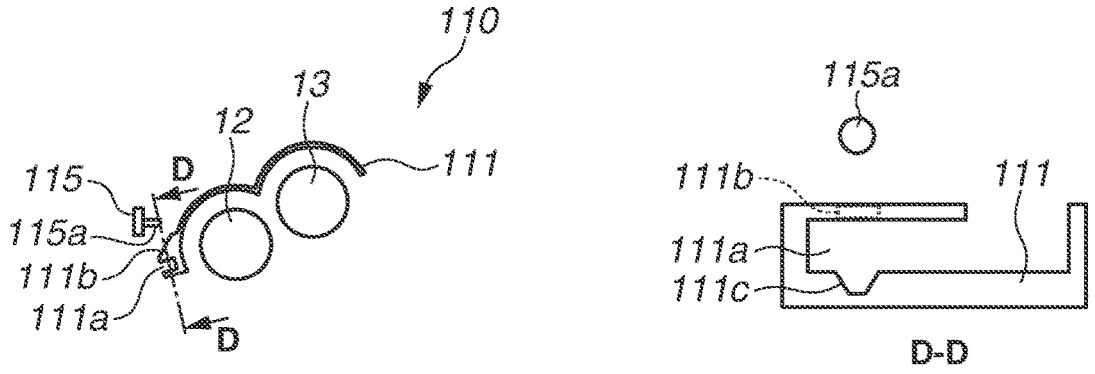
FIGS. 12A, 12B, and 12C are each a schematic sectional diagram illustrating an attachment procedure of a sheet feeding roller unit according to a second exemplary embodiment.
Figure 12B:
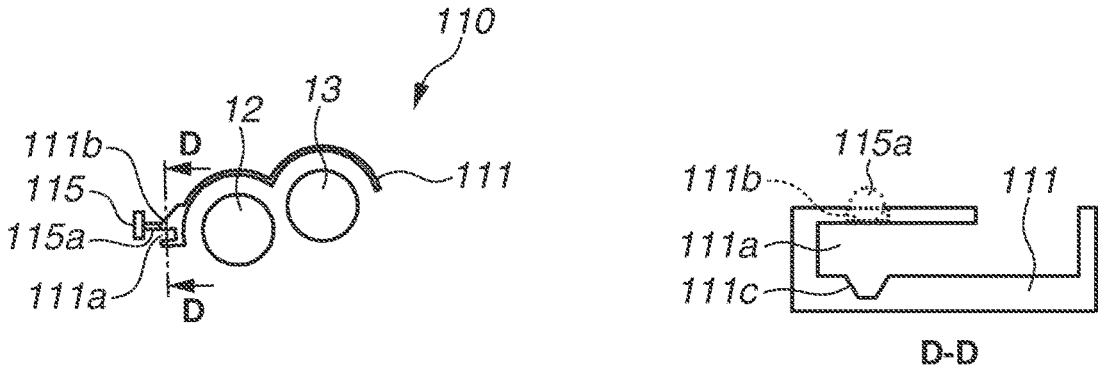
Figure 12C:
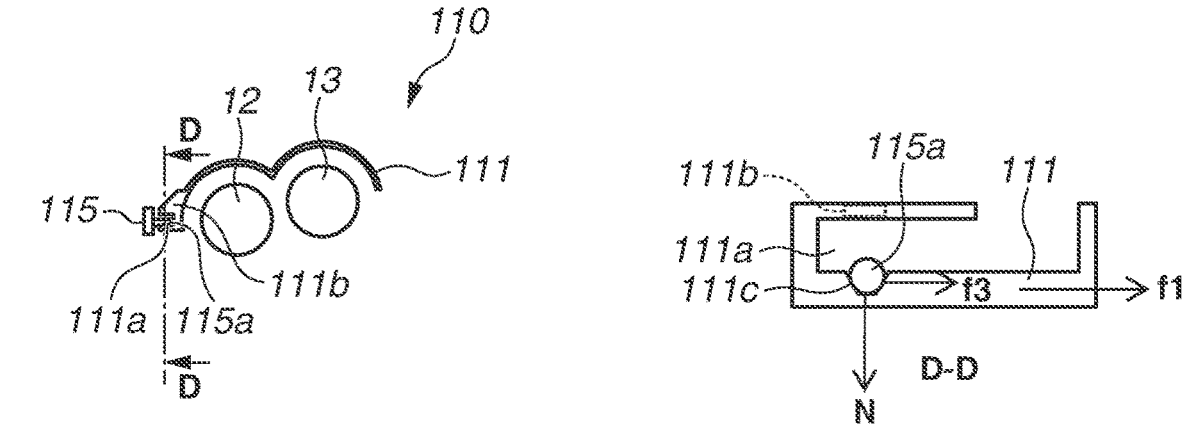
Figure 13:
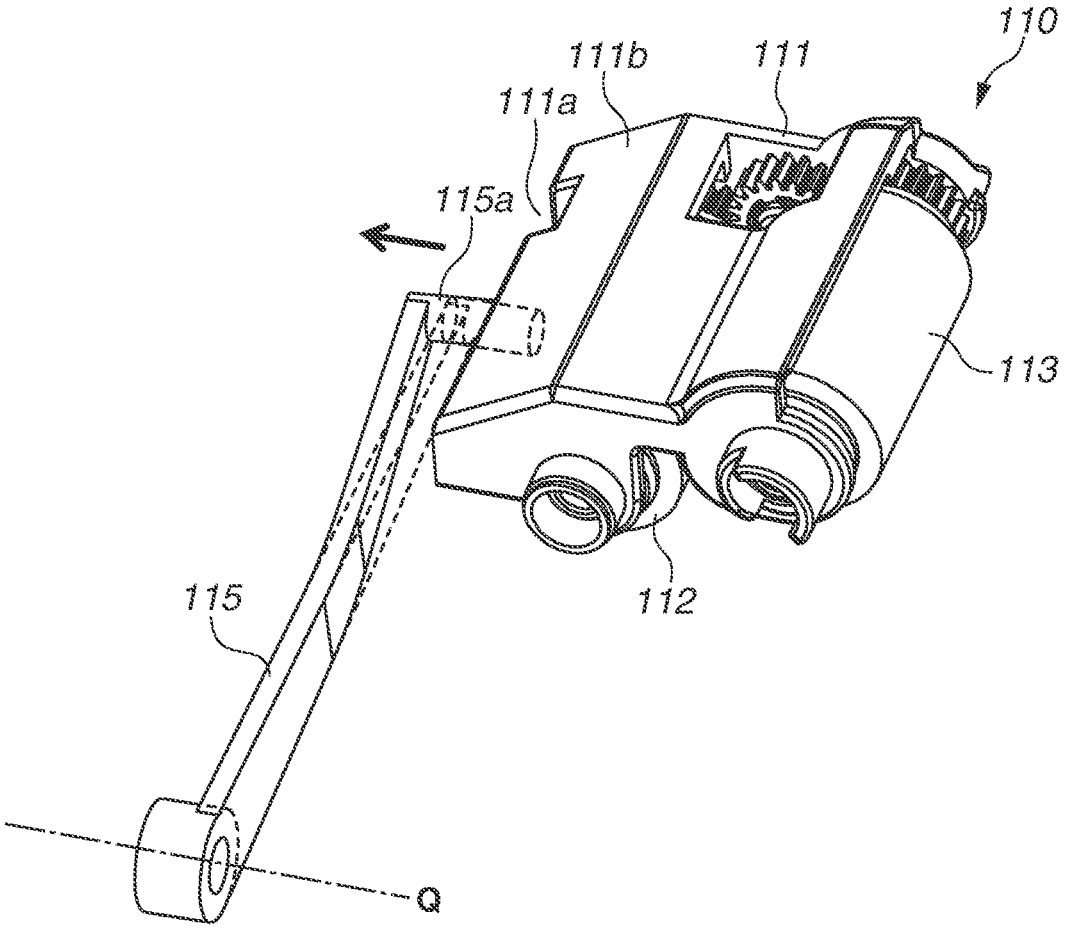
FIG. 13 is a schematic perspective diagram illustrating a state caused when a pressing arm according to the second exemplary embodiment retracts.

FIGS. 12A, 12B, and 12C are each a schematic sectional diagram illustrating an attachment procedure of the sheet feeding roller unit 110. The orientation of the sheet feeding roller unit 110 is illustrated on the left side, and a relationship between the pressing arm 115 and the sheet feeding roller unit 110 is illustrated on the right side. FIG. 13 is a perspective diagram illustrating a state when the pressing arm 115 retracts. The parts similar to those in the first exemplary embodiment are assigned the same reference numerals, and the description thereof will be omitted.

FIG. 12A illustrates a state in which the sheet feeding roller unit 110 is held between the slide bearing 70 and the feed bearing 23, and is not engaged with the pressing arm 115. FIG. 12B illustrates a state in which the sheet feeding roller unit 110 is caused to pivot and the pressing arm 115 is retracted. FIG. 12C illustrates a state in which the attachment of the sheet feeding roller unit 110 is completed.

In the present exemplary embodiment, the roller holder 111 of the sheet feeding roller unit 110 has the engagement slit 111*a* that engages with the engagement boss 115*a* of the pressing arm 115, and the recessed portion 111*c* is formed in the engagement slit 111*a*. Furthermore, a slope portion 111*b* for retracting the pressing arm 115 in an arrow direction in FIG. 13 in an attachment operation of the sheet feeding roller unit 110 is provided on the roller holder 111.

The slope portion 111*b* is inclined to cause the pressing arm 115 to retract in an attachment operation of the sheet feeding roller unit 110, which will be described below. Specifically, the slope portion 111*b* extends toward the direction of the engagement boss 115*a* from an upper portion to a lower portion in the vertical direction in a state of being attached to the apparatus main body.

The pressing arm 115 is provided with the engagement boss 115*a* that fits into the engagement slit 111*a* of the sheet feeding roller unit 110 and engages with the sheet feeding roller unit 110, and is held to be pivotable around the pivot axis Q as in the first exemplary embodiment. Furthermore, the pressing arm 115 has flexibility in such a manner that the engagement boss 115*a* is retractable in the direction of the pivot axis Q, and in a direction away from the sheet feeding roller unit 110 (arrow direction in FIG. 13).

An attachment operation of a sheet feeding roller will be described. As in the first exemplary embodiment, an operator moves the slide shaft 22 in a direction of resisting the slide spring pressure f1, and attaches the sheet feeding roller unit 110 to a position between the slide bearing 70 and the feed bearing 23. At this time, a phase of the sheet feeding roller unit 110 may be any phase.

If the sheet feeding roller unit 110 is caused to pivot around the rotational axis of the feed roller 13 toward the pressing arm 115 after the attachment, a slope portion 111*b* of the sheet feeding roller unit 110 comes into contact with the leading end of the engagement boss 115*a* of the pressing arm 115. If the sheet feeding roller unit 110 is then caused to further pivot toward the pressing arm 115, the pressing arm 115 is pressed by the slope portion 111*b* of the sheet feeding roller unit 110, and the pressing arm 115 warps in the arrow direction as illustrated in FIG. 13. The pressing arm 115 then returns to an original orientation by its elastic force, so that the engagement boss 115*a* of the pressing arm 115 engages with the engagement slit 111*a* of the sheet feeding roller unit 110.

When force of the feeding pressure urging member 16 is added to the pressing arm 115, before the pressing arm 115 causes the sheet feeding roller unit 110 to pivot, the pressing arm 115 warps and retracts also in the present exemplary embodiment. As in the first exemplary embodiment, when the sheet feeding cassette 30 is attached when the sheet feeding roller unit 110 is in the first state, the sheet feeding roller unit 110 is completely attached.

In the present exemplary embodiment, a recessed portion 110*c* is formed in the sheet feeding roller unit 110, and the engagement boss 115*a* of the pressing arm 115 fits into the recessed portion 110*c* in a state in which the feeding pressure N is applied from the pressing arm 115. A holding force necessary for the sheet feeding roller unit 110 is then ensured. The state illustrated in FIG. 12C is a state in which the stacking plate 32 moves upward and the sheet S is urged with the feeding pressure N from the pickup roller 12. In this state, the feeding pressure N generated by the feeding pressure urging member 16 acts on the recessed portion 111*c* via the engagement boss 115*a*.

Thus, to move the sheet feeding roller unit 110 in a retracting direction of the slide shaft 22, force f3 for the engagement boss 115*a* to climb over the recessed portion 111*c* is to be applied in addition to the pressure f1 of the slide spring 24. As in the first exemplary embodiment, the pressure of the slide spring 24 and a recess shape are determined in such a manner that the force becomes holding force sufficient in a sheet feeding operation and jam handling. In contrast, when the sheet feeding roller unit 110 is detached, as in the first exemplary embodiment, the engagement boss 115*a* of the pressing arm 115 is disengaged from the recessed portion 111*c*. Accordingly, when the sheet feeding roller unit 110 is detached, the sheet feeding roller unit 110 can be moved only with force against the pressure f1 of the slide spring 24.

In such a manner, by providing a resistive shape (the recessed portion 111*c*) that acts only when the pressing arm 115 is in pressure contact with the sheet feeding roller unit 110, it is possible to achieve both ensuring of a holding force for the sheet feeding roller unit 110 in sheet feeding and an operational force reduction in detachment of the sheet feeding roller unit 110.

As described above, also in the present exemplary embodiment, if the sheet feeding roller unit 110 comes into pressure contact with the sheet S, the engagement boss 115*a* of the pressing arm 115 fits into the recessed portion 111*c* of the sheet feeding roller unit 110, and when the sheet feeding roller unit 110 is detached, the engagement boss 115*a* is disengaged from the recessed portion 111*c*. It is therefore possible to lower the pressure f1 of the slide spring 24 while ensuring holding force for the sheet feeding roller unit 110 with the above-described force f3 in usage. It is consequently possible to reduce operational force in the replacement of the sheet feeding roller unit 110.

An attachment step of the sheet feeding roller unit 110 is performed through two steps including the engagement with the slide shaft 22 and the engagement with the pressing arm 115, so that an operator can concentrate on each work. Thus, workability in the replacement of the sheet feeding roller unit 110 can be improved.

It is possible to attain this function only by a retracting configuration of an engagement unit of the pressing arm 115 for engaging with the sheet feeding roller unit 110. It is therefore possible to enhance usability in replacement of the sheet feeding roller unit 110 with lower cost and a smaller space. Furthermore, it is possible to further save cost because there is no need to divide a pressing arm as in the first exemplary embodiment while a space for warp of the pressing arm is to be provided in the present exemplary embodiment.

A third exemplary embodiment of the present invention will be described below. In the above-described first and exemplary embodiments, a configuration has been described in which a sheet feeding roller unit pivots, and comes into contact with a pressing arm, and then the pressing arm retracts. In the present exemplary embodiment, a configuration in which a boss of a sheet feeding roller retracts will be described with reference to FIGS. 14A, 14B, and 14C. The parts similar to those in the first and second exemplary embodiments are assigned the same reference numerals, and the description thereof will be omitted.

Figure 14A:
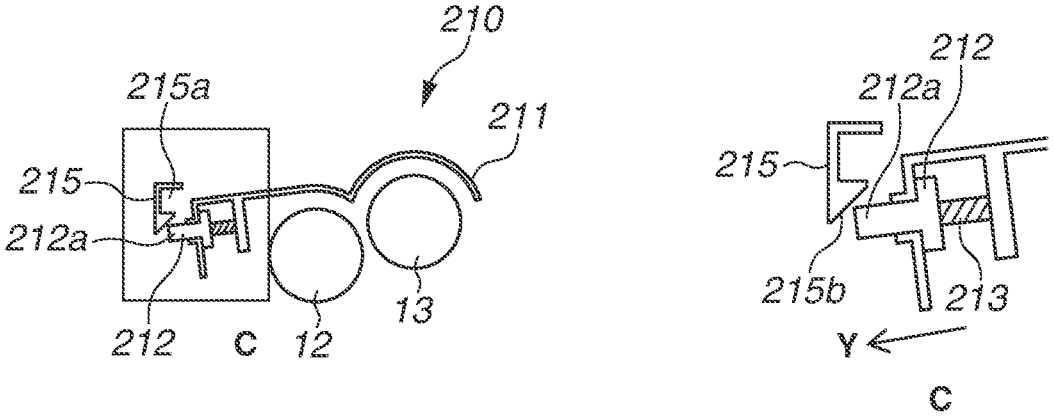
FIGS. 14A, 14B, and 14C are schematic sectional diagrams illustrating an attachment procedure of a sheet feeding roller unit according to a third exemplary embodiment.
Figure 14B:
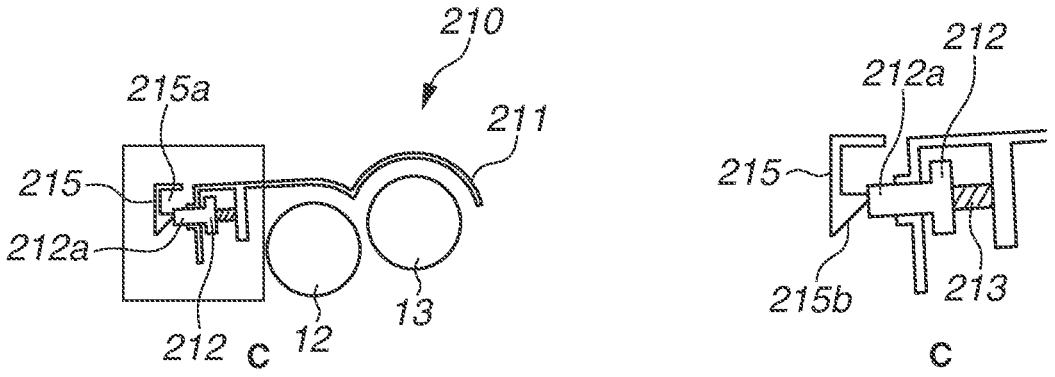
Figure 14C:
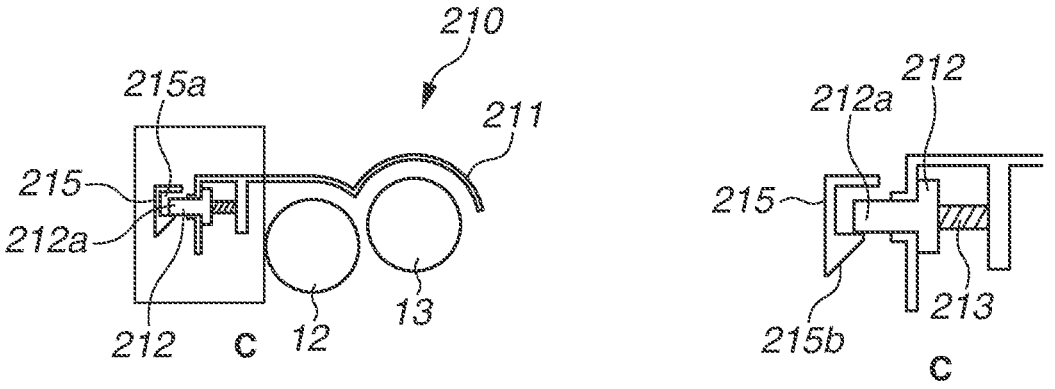

FIGS. 14A, 14B, and 14C are each schematic sectional diagrams illustrating an attachment procedure of a sheet feeding roller unit 210. The orientation of the sheet feeding roller unit 210 is illustrated on the left side, and an enlarged diagram illustrating a relationship between an engagement member 212, a boss 212*a* (second engagement unit) of the engagement member 212, and a pressing arm 215 that engages with the boss 212*a* is illustrated on the right side.

In the present exemplary embodiment, the boss 212*a* and a slit 215*a* (second engaged unit) of the pressing arm 215 engage with each other. FIG. 14A illustrates a state in which the sheet feeding roller unit 210 is held between the slide bearing 70 and the feed bearing 23, and the sheet feeding roller unit 210 is caused to pivot to come into contact with the pressing arm 215. FIG. 14B illustrates a state in which the engagement member 212 retracts. FIG. 14C illustrates a state when the attachment of the sheet feeding roller unit 210 is completed.

Unlike the first and second exemplary embodiments, in the present exemplary embodiment, a configuration in which the engagement member 212 on the sheet feeding roller unit 210 retracts is employed. In the sheet feeding roller unit 210 in the present exemplary embodiment, the engagement member 212 includes a different component, and is urged by an engagement spring 213 serving as an urging member. In contrast, a retracting configuration such as the cap 18 in the first exemplary embodiment is not arranged on the pressing arm 215. A slope portion 215*b* for generating force for retracting the engagement member 212 against the engagement spring 213 when the boss 212*a* comes into contact is provided on the pressing arm 215.

An attachment operation of the sheet feeding roller unit 210 will be described with reference to FIGS. 14A, 14B, and 14C. As in the first and second exemplary embodiments, an operator moves the slide shaft 22 in a direction of resisting the slide spring pressure f1, and attaches the sheet feeding roller unit 210 to a position between the slide bearing 70 and the feed bearing 23. At this time, a phase of the sheet feeding roller unit 210 may be any phase.

After that, if the sheet feeding roller unit 210 is caused to pivot about the rotational axis of the feed roller 13 toward the pressing arm 215, the boss 212*a* of the sheet feeding roller unit 210 comes into contact with the slope portion 215*b* of the pressing arm 215 (FIG. 14A). The engagement member 212 is then urged toward the pressing arm 215, so that the engagement member 212 retracts to a retracted position in a direction opposite to a Y direction (FIG. 14B). Furthermore, the sheet feeding roller unit 210 is pushed in the direction of the pressing arm 215, so that the engagement member 212 returns to a steady-state position, enters the slit 215*a* in the pressing arm 215, and engages with the pressing arm 215 (FIG. 14C).

In other words, the boss 212*a* moves in a direction away from the pressing arm 215 and the slit 215*a*, when the boss 212*a* comes into contact with the slope portion 215*b* of the pressing arm 215 to move the sheet feeding roller unit 210 from the first position to the second position. More specifically, in a direction intersecting with a pivot axis of the sheet feeding roller unit 210, the boss 212*a* moves in a direction away from the pressing arm 215 and the slit 215*a*, and in a direction approaching the pivot axis of the sheet feeding roller unit 210.

The engagement member 212 of the sheet feeding roller unit 210 is set in such a manner that the engagement member 212 is retractable with force generated by the feeding pressure urging member 16 in the present exemplary embodiment as well. As in the first exemplary embodiment, the sheet feeding roller unit 210 is automatically attached even if the sheet feeding roller unit 210 is in the first state.

In such a manner, an attachment step of the sheet feeding roller unit 210 is performed through two steps including engagement with the slide shaft 22 and engagement with the pressing arm 215 in the present exemplary embodiment as well. This enables an operator to concentrate on each work, thus improving workability in the replacement of the sheet feeding roller unit 210.

It is also possible to attain such a function only by a retracting configuration of an engagement unit (engagement member) of the sheet feeding roller unit 210 for engaging with the pressing arm 215. It is therefore possible to enhance usability in replacement of the sheet feeding roller unit 210 with lower cost and a smaller space. Furthermore, such a configuration provides additional degrees of freedom in the design to increase the strength of a pressing arm that applies a feeding pressure because separate pressing arms are to be provided as in the first exemplary embodiment. In the present exemplary embodiment, a configuration of urging the engagement member 212 using the engagement spring 213 has been described. Alternatively, a configuration in which an engagement member itself or a part of an engagement member has flexibility and deforms as in the second exemplary embodiment may be employed.

A fourth exemplary embodiment of the present invention will be described below. In the second exemplary embodiment, a configuration in which the entire pressing arm warps and retracts has been described. In the present exemplary embodiment, a configuration in which a part of a pressing arm warps and an engagement unit retracts will be described with reference to FIGS. 15A, 15B, and 15C. The parts similar to those in the first and second exemplary embodiments are assigned the same reference numerals, and the description thereof will be omitted.

Figure 15A:
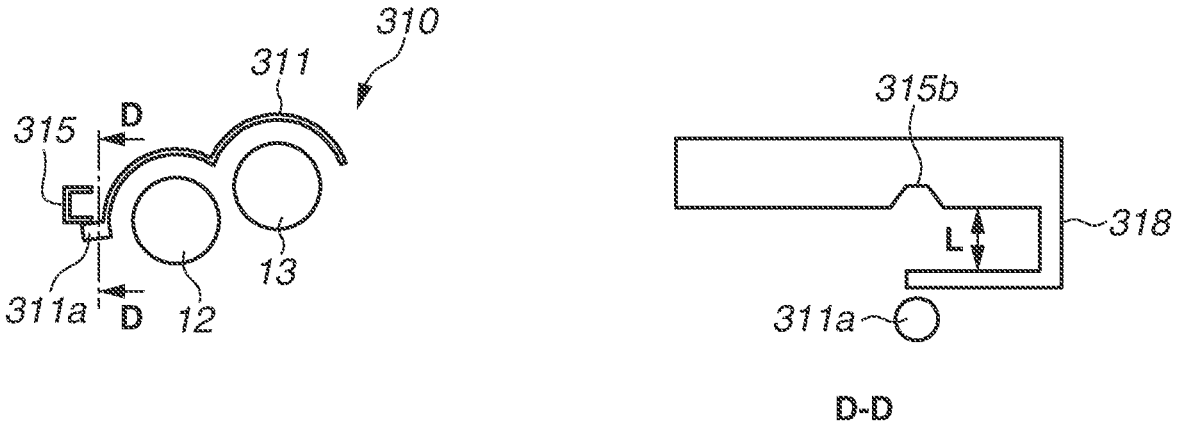
FIGS. 15A, 15B, and 15C are schematic sectional diagrams illustrating an attachment procedure of a sheet feeding roller unit according to a fourth exemplary embodiment.
Figure 15B:
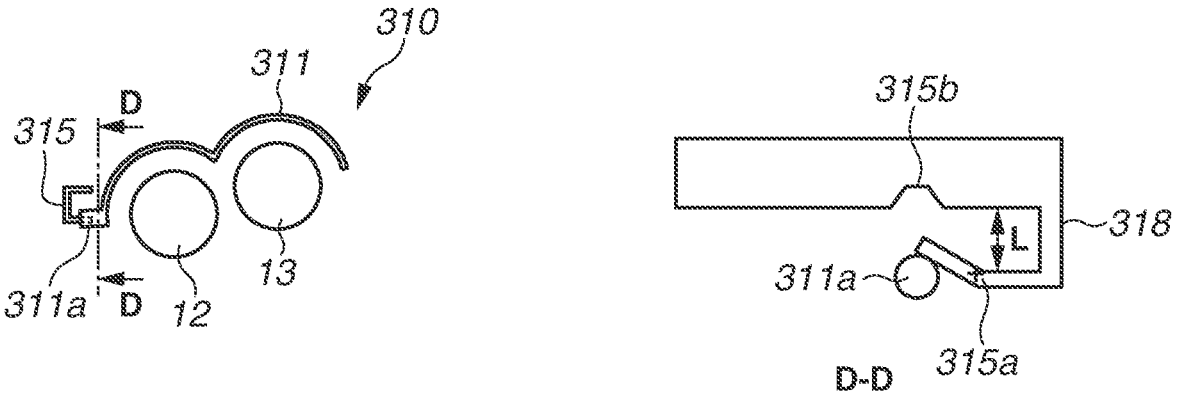
Figure 15C:
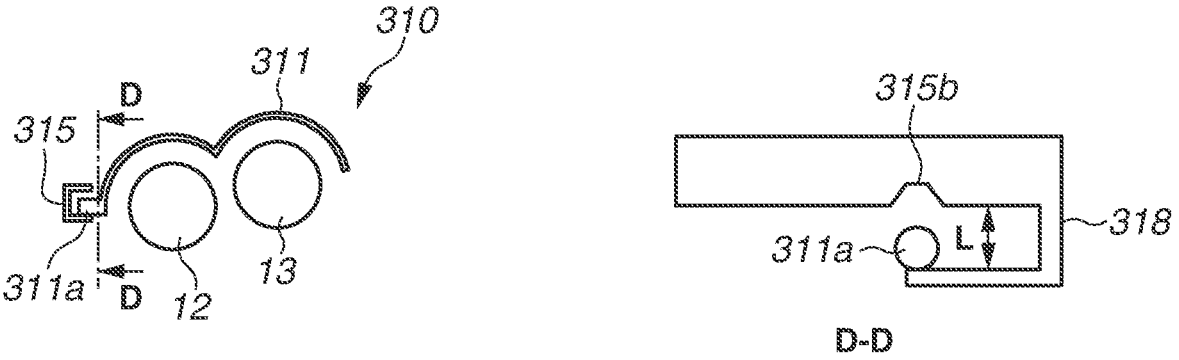

FIGS. 15A, 15B, and 15C are each schematic sectional diagrams illustrating an attachment procedure of a sheet feeding roller unit 310. The orientation of the sheet feeding roller unit 310 is illustrated on the left side, and an enlarged diagram illustrating a relationship between an engagement boss 311*a* serving as a second engagement unit, and a cap 318 of a pressing arm serving as a second engaged unit is illustrated on the right side. FIG. 15A illustrates a state in which the sheet feeding roller unit 310 is held between the slide bearing 70 and the feed bearing 23, and the sheet feeding roller unit 310 is caused to pivot to come into contact with the cap 318. FIG. 15B illustrates a state in which the cap 318 retracts. FIG. 15C illustrates a state when the attachment of the sheet feeding roller unit 310 is completed.

Unlike the second exemplary embodiment, in the present exemplary embodiment, a configuration in which not the entire arm but a part of the cap 318 deforms and retracts is employed. The cap 318 in the present exemplary embodiment includes a deformable deformation portion 315*a*. More specifically, the deformation portion 315*a* having intentionally-decreased strength is arranged at a part of the leading end of the sheet feeding roller unit 310 that engages with the engagement boss 311*a*. In contrast, in the sheet feeding roller unit 310, the engagement boss 311*a* is provided with on a roller holder 311 as in the first exemplary embodiment.

An attachment operation of the sheet feeding roller unit 310 will be described with reference to FIGS. 15A, 15B, and 15C. As in the first exemplary embodiment, an operator moves the slide shaft 22 in a direction against the slide spring pressure f1, and attaches the sheet feeding roller unit 310 to a position between the slide bearing 70 and the feed bearing 23. At this time, a phase of the sheet feeding roller unit 310 may be any phase. If the sheet feeding roller unit 310 is then caused to pivot around the rotational axis of the feed roller 13 toward the cap 318, the engagement boss 311*a* of the sheet feeding roller unit 310 comes into contact with the cap 318 (FIG. 15A).

The deformation portion 315*a* is formed integrally with the cap 318, and has flexibility by locally making the deformation portion 315*a* thin-walled. Thus, the deformation portion 315*a* is configured to bend by the engagement boss 311*a* of the sheet feeding roller unit 310 being urged toward the cap 318 (FIG. 15B). If the engagement boss 311*a* enters by a fixed distance or more, the deformation portion 315*a* retracts from a movement path of the engagement boss 311*a*. After that, by the deformation portion 315*a* of the cap 318 returning to an original orientation by its elastic force, the deformation portion 315*a* engages with the pressing arm 15 (FIG. 15C).

An example in which the deformation portion 315*a* locally bends has been described as a specific configuration of the present exemplary embodiment, but the present exemplary embodiment is not limited to such a configuration. As another configuration, a configuration in which the deformation portion 315*a* wholly bends may be employed.

The deformation portion 315*a* of the cap 318 is set in such a manner that the deformation portion 315*a* is retractable with the force generated by the feeding pressure urging member 16 also in the present exemplary embodiment. As in the first exemplary embodiment, the sheet feeding roller unit 310 is automatically attached even if the sheet feeding roller unit 310 is in the first state. In such a manner, an attachment step of the sheet feeding roller unit 310 is performed through two steps including engagement with the slide shaft 22 and engagement with the pressing arm 15 in the present exemplary embodiment as well. This enables an operator to concentrate on each work, thus providing high workability in the replacement of the sheet feeding roller unit 310.

In the present exemplary embodiment, a distance for the deformation portion 315*a* to retract from the engagement boss 311*a* becomes longer.

Thus, a large space L is to be provided in the cap 318. However, the deformation portion 315*a* is formed integrally with the cap 318 and a part of the cap 318 is deformed as in the present exemplary embodiment, so that lower cost can be achieved while the strength of the cap 318 itself is ensured.

According to an exemplary embodiment of the present invention, it is possible to provide a sheet feeding device to which a roller unit including a roller that conveys sheets is easily attachable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2021-195324, filed Dec. 1, 2021, and No. 2021-195325, filed Dec. 1, 2021, which are hereby incorporated by reference herein in their entirety.

What is claimed is:

1. A sheet feeding device comprising:

a sheet storage unit configured to store a sheet;

a roller unit including a first roller, and a second roller configured to convey the sheet stored in the sheet storage unit, and having a first engagement unit and a second engagement unit; and an apparatus main body including:

a first engaged unit including a holding member that is movable in a direction of an axis line of the first roller, the first engaged unit being configured to engage with the first engagement unit by moving in a first direction; and a pressing arm including an arm portion and a second engaged unit attached to the arm portion and movable relative to the arm portion, the second engaged unit being configured to engage with the second engagement unit, the pressing arm being configured to press the roller unit in a direction in which the second roller is urged against the sheet stored in the sheet storage unit, wherein the roller unit is attachable to and detachable from the apparatus main body, wherein the roller unit is rotatable about the first engagement unit from (i) a first position at which the first engagement unit and the first engaged unit are engaged with each other, and the second engagement unit and the second engaged unit are not engaged with each other to (ii) a second position at which the first engagement unit and the first engaged unit are engaged with each other, and the second engagement unit and the second engaged unit are engaged with each other, and wherein, when the roller unit moves from the first position to the second position, the second engagement unit presses the second engaged unit such that the second engaged unit moves to a position retracted from a movement locus of the second engagement unit.

2. The sheet feeding device according to claim 1, wherein the second roller is a pickup roller configured to come into contact with the sheet stored in the sheet storage unit, and the first roller is a feed roller configured to form a separation nip portion for separating sheets conveyed from the pickup roller, one by one.

3. The sheet feeding device according to claim 1, wherein the second engaged unit is urged by an urging member, wherein the second engaged unit includes a slope portion, wherein, when the second engagement unit presses the slope portion, the second engaged unit moves to the position retracted from the movement locus of the second engagement unit, and wherein the slope portion is inclined in such a manner that, when the second engaged unit retracts from the movement locus of the second engagement unit, the second engaged unit retracts in a direction opposite to a direction in which the second engaged unit is urged by the urging member.

4. The sheet feeding device according to claim 1, wherein the pressing arm has flexibility in such a manner that the second engaged unit is retractable.

5. The sheet feeding device according to claim 1, wherein the second engaged unit includes a deformable deformation portion, and by the deformation portion deforming, the second engaged unit moves to the position retracted from the movement locus of the second engagement unit.

6. A sheet feeding device comprising:

a sheet feeding roller unit including a first roller, a second roller, a first engagement unit, and a second engagement unit;

a sheet storage unit configured to store a sheet; and an apparatus main body including:

a first engaged unit including a holding member that is movable in a direction of an axis line of the first roller, the first engaged unit being configured to engage with the first engagement unit by moving in a first direction;

an urging member configured to urge the holding member in the first direction; and a pressing arm having a second engaged unit and a regulation groove having a regulation surface, the pressing arm being configured to urge the second roller in an urging direction in which the second roller is urged against the sheet stored in the sheet storage unit, the second engaged unit being configured to engage with the second engagement unit, wherein the sheet feeding roller unit is detachable from the apparatus main body by moving in a second direction opposite to the first direction, wherein the regulation surface is configured to regulate a movement of the second engagement unit in the direction of the axis line when the second roller is urged by the pressing arm in the urging direction, wherein regulation by the regulation surface is cancelled when the second roller is not urged by the pressing arm in the urging direction, and wherein the regulation surface is inclined with respect to the direction of the axis line and a vertical direction.

7. The sheet feeding device according to claim 6, wherein the first roller is a feed roller configured to form a separation nip portion for separating sheets one by one, and the second roller is a pickup roller configured to come into contact with the sheet stored in the sheet storage unit.

8. The sheet feeding device according to claim 6, wherein a width of the regulation groove in the direction of the axis line is larger than a width of the second engagement unit in the direction of the axis line, and the second engagement unit comes into contact with the regulation surface when the second engagement unit moves in the second direction by a predetermined distance.

9. The sheet feeding device according to claim 6, wherein, when the pressing arm is not urged in the urging direction, the second engagement unit and the regulation groove do not come into contact with each other.

* * * * *